US005127492A

United States Patent [19]

Preston

[11] Patent Number: 5,127,492

[45] Date of Patent: Jul. 7, 1992

[54] SCAFFOLDING

[76] Inventor: John C. Preston, 12 Wentworth Road, Eastwood, New South Wales 2122, Australia

[21] Appl. No.: 466,261

[22] PCT Filed: Jun. 14, 1989

[86] PCT No.: PCT/AU89/00255

§ 371 Date: Mar. 14, 1990

§ 102(e) Date: Mar. 14, 1990

[87] PCT Pub. No.: WO89/12725

PCT Pub. Date: Dec. 28, 1989

[30] Foreign Application Priority Data

Jun. 14, 1988 [AU] Australia ..... PI8756

[51] Int. Cl.[5] ..... E04G 1/34

[52] U.S. Cl. ..... 182/152; 182/178; 182/229

[58] Field of Search ..... 182/178, 179, 229, 152, 182/; 248/238; 108/55.3

[56] References Cited

U.S. PATENT DOCUMENTS

| | | | |
|---|---|---|---|
| 3,392,801 | 7/1968 | Gethmann | 182/178 |
| 3,403,751 | 10/1968 | Yoder | 182/229 |
| 4,226,192 | 10/1980 | Myers | 108/55.3 |
| 4,452,337 | 6/1984 | Atzinger | 182/178 |
| 4,620,608 | 11/1986 | Gilbreath | 182/178 |
| 4,703,702 | 11/1987 | Speicher | 182/178 |
| 4,773,506 | 9/1988 | Preston | 182/178 |

*Primary Examiner*—Reinaldo P. Machado
*Attorney, Agent, or Firm*—Ladas & Parry

[57] ABSTRACT

A stackable sacffold module (11) having four vertically extending support columns or members (13,14) to which there is pivotally attached at least two work platforms (12), there is further provided clamps (44) which retain the work platforms (12) fixed to the support columns (13,14), when the module (11) is in an erect configuration. The clamps (44) are releasable to allow folding of the module (11) to a transport configurations, with the support members (13, 14) being located adjacent each other.

6 Claims, 25 Drawing Sheets

67
70
71
73
69
68
18
62
74
72
63
65
66
75

SCAFFOLDING

BACKGROUND OF THE INVENTION

The present invention relates to methods and apparatus for scaffolding and more particularly but not exclusively to an improvement in or modification of the scaffolding described in U.S. Pat. No. 4,773,506.

PRIOR ART

Conventional scaffolding has many problems, the most prominent thereof being that they are labour intensive to erect and do not provide a co-ordinated scaffold system adapted to meet the varying requirements particularly of high rise scaffolding.

Described in the above U.S. Pat. No. is a folding scaffold module which is stackable. This also disclosed in U.S. Pat. No. 1,284,078, a collapsible tower. This collapsible tower is not adapted to be stacked and accordingly does not lend itself to industrial type scaffolding. U.S. Pat. No. 3,463,265 discloses a collapsible platform support, but again it is not intended to be stacked and is not integrated with platforms to facilitate easy installation of the scaffolding.

SUMMARY OF THE INVENTION

It is the object of the present invention to overcome or substantially ameliorate the above disadvantages.

Therein disclosed herein a stackable scaffolding module having four elongated verticle support members which are generally parallel and co-extensive;

at least two work platforms adapted to the building materials and bear the weight of workman, which platforms are supported by the support members at vertically spaced locations, said platforms being of generally rectangular or square configuration at;

pivot means attaching each platform to the support members so that each support member is located adjacent a respective one of the corners of each platform and permitting relative pivotting movement between each platform and the support members about 2 parallel axis extending generally parallel to the side of each platform;

releasable securing means for preventing pivotting of the platforms relative to the support members so that the module is foldable between an erect configuration with the platforms normal to the support members when a securing means is engaged and a folded configuration with the support members pivotted relative to the platform so that support members are located adjacent each other when the securing means is released thereby reducing overall space occupied by the module to facilitate storage and transportation of the module.

A preferred form of the present invention will now be described by way of example with reference to the accompanying drawings wherein.

Figure 1:
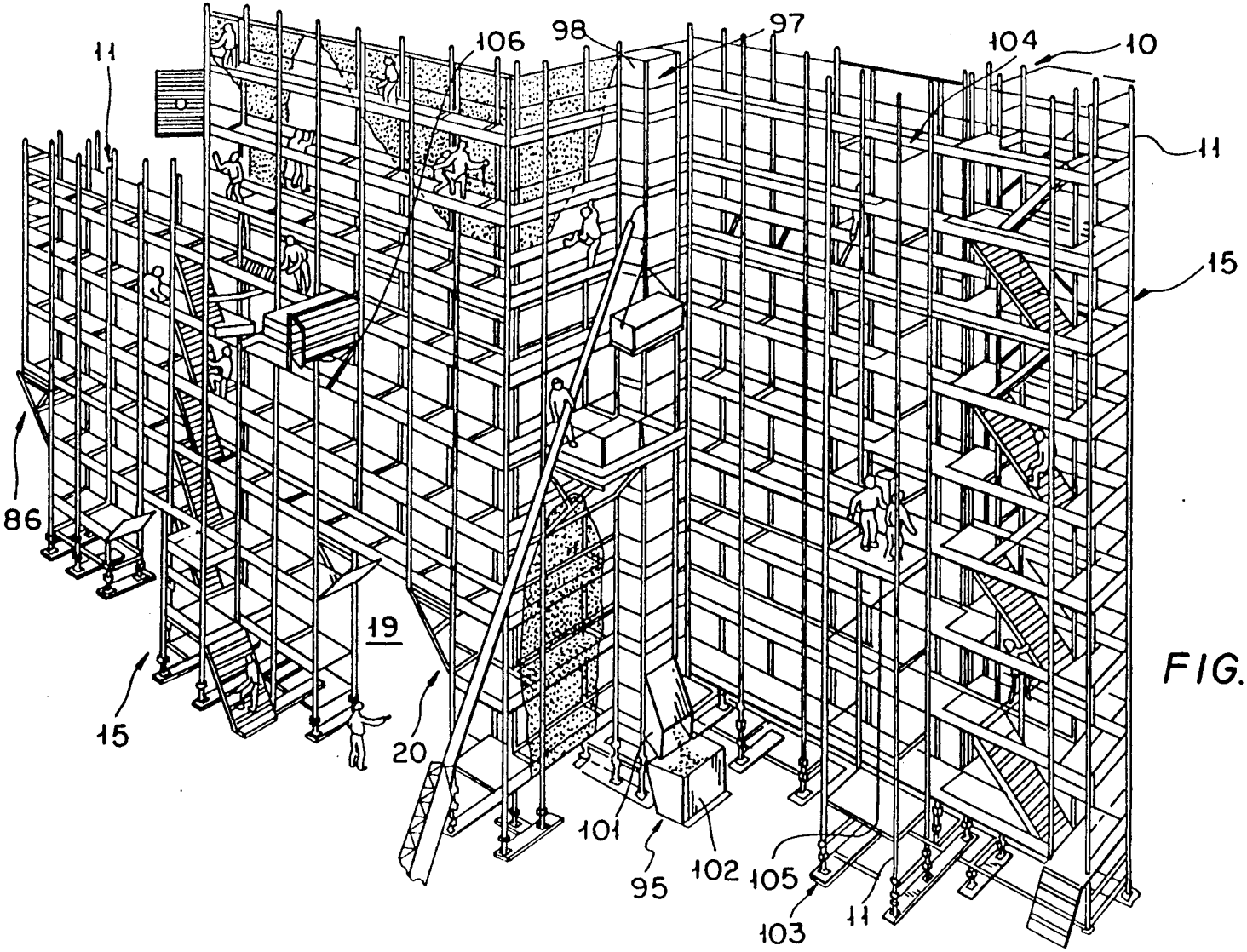
FIG. 1 is a schematic perspective view of a scaffold assembly.
Figure 2:
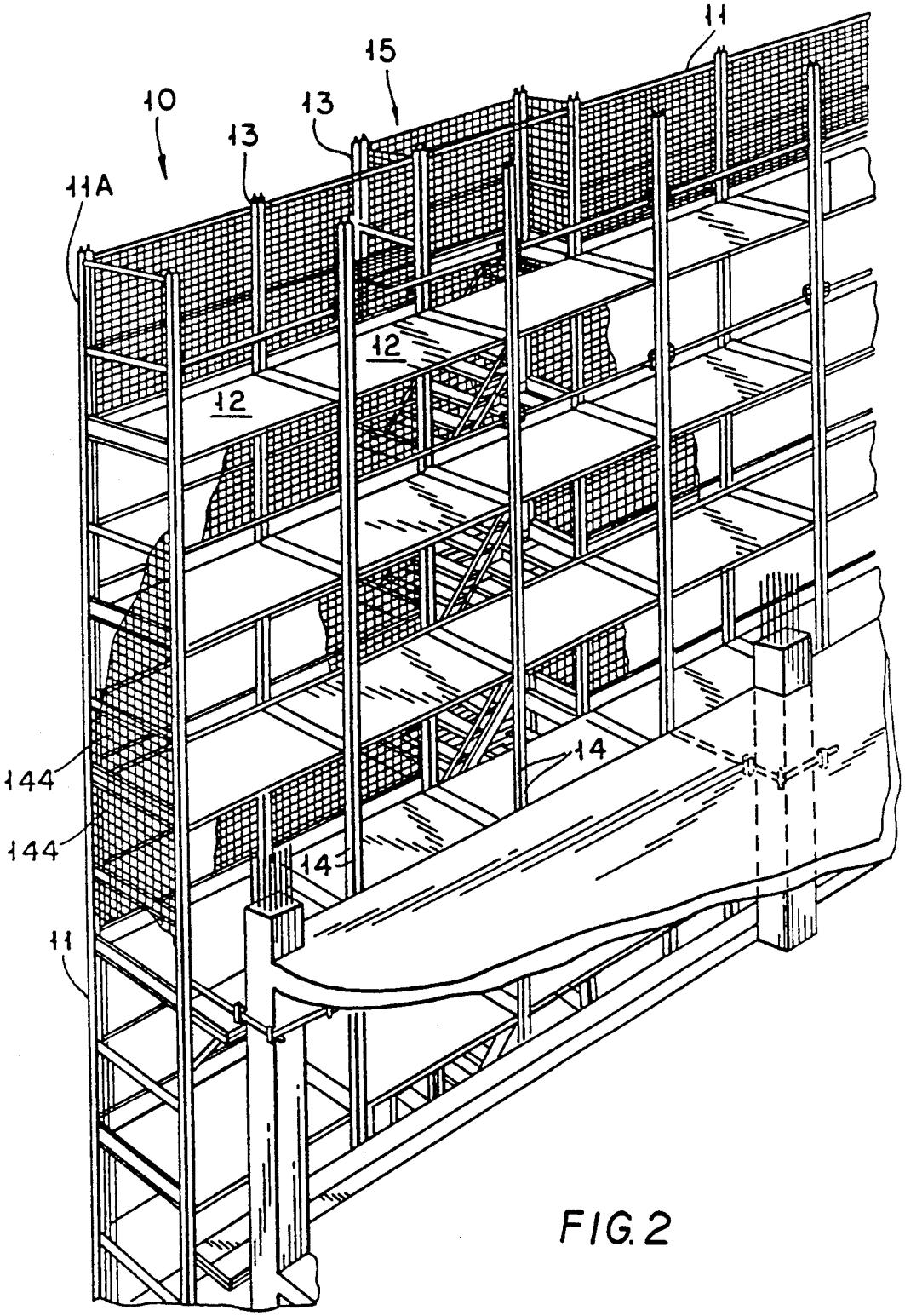
FIG. 2 is a schematic perspective of a portion of scaffold of FIG. 1.
Figure 3:
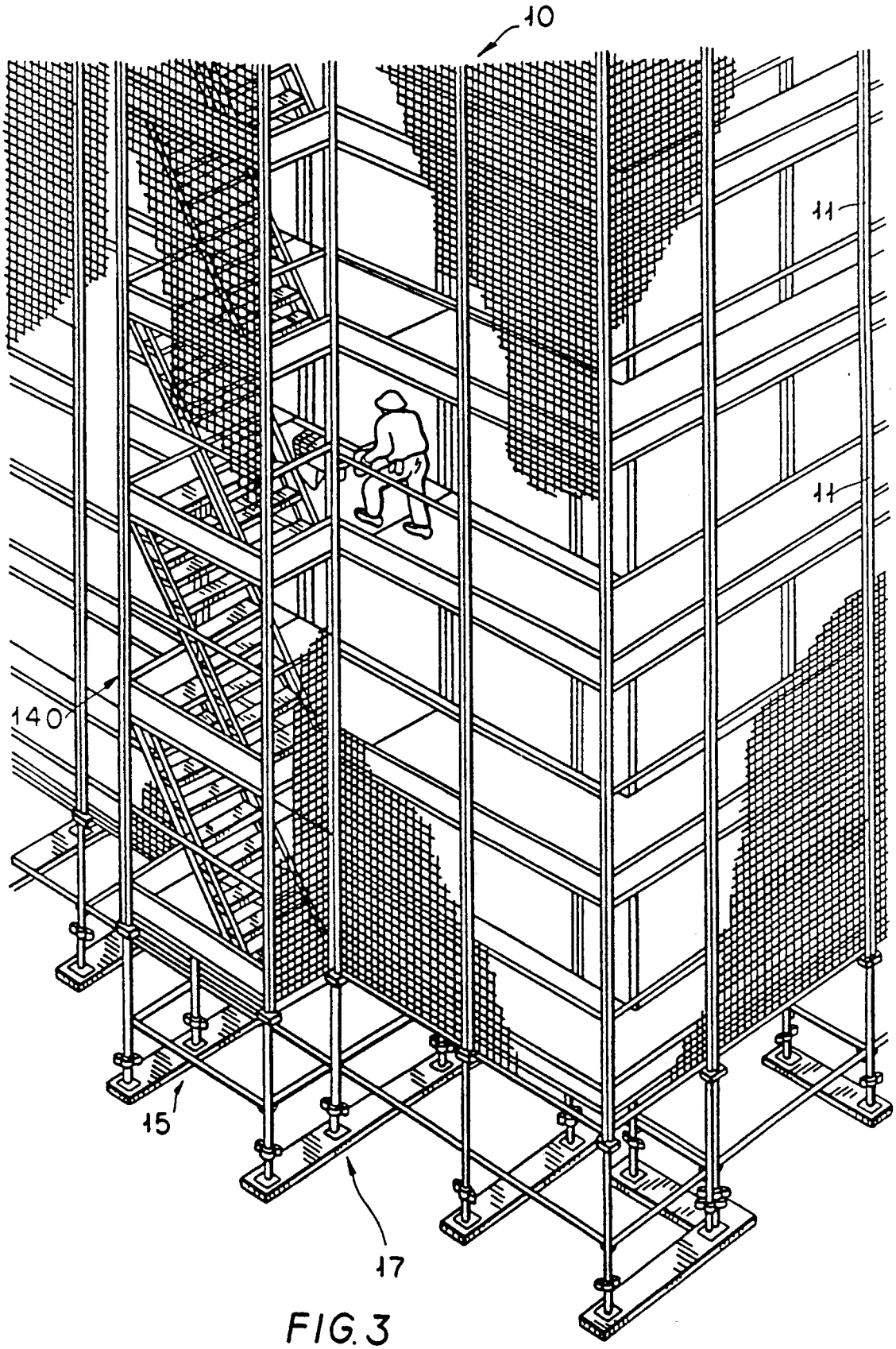
FIG. 3 is a schematic perspective view of a further portion of the scaffold of FIG. 1.
Figure 5:
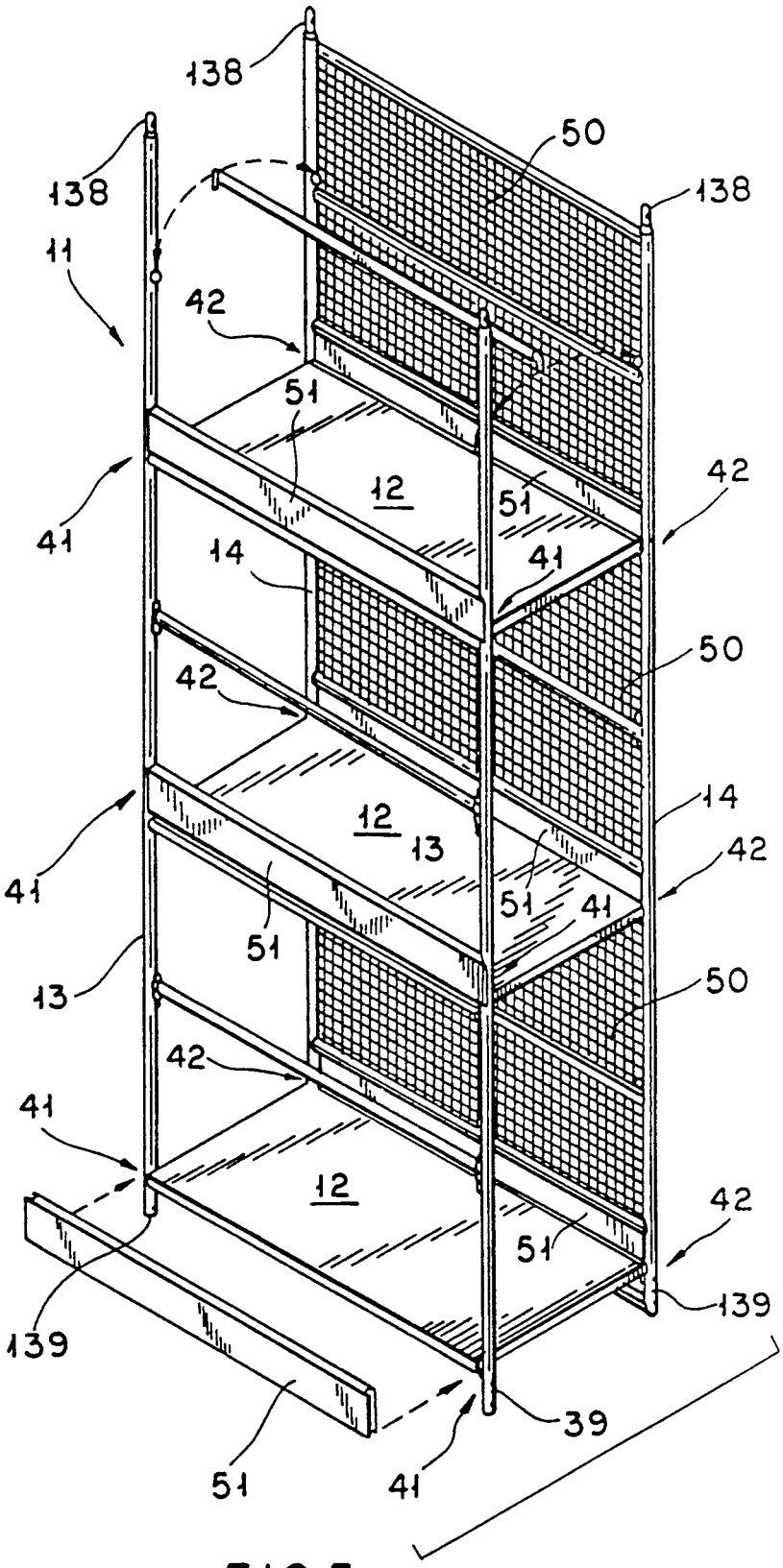
FIG. 5 is a schematic perspective view of a further module employed in the scaffold of FIG. 1.

In FIGS. 1 2 and 3 there is schematically depicted a scaffold assembly 10. The scaffold assembly 10 includes a plurality of scaffold modules 11 which are vertically stacked by means of cranes as will be described with reference to FIGS. 29 to 34. As best seen in FIG. 5, each module 11 has a plurality of platforms 12 joined by generally vertically extending parallel coextensive columns 13 and 14. The pair of columns 13 is located adjacent the building, and the pair of columns 14 are located remote from the building. The upper ends of the column 13 are divided with the projections 138, while the base of the column 13 are provided with tubular sockets 139. When the modules 11 are stacked, the projections 138 are telescopically received within the tubular sockets 139 of the next vertically adjacent module 11.

Figure 6:
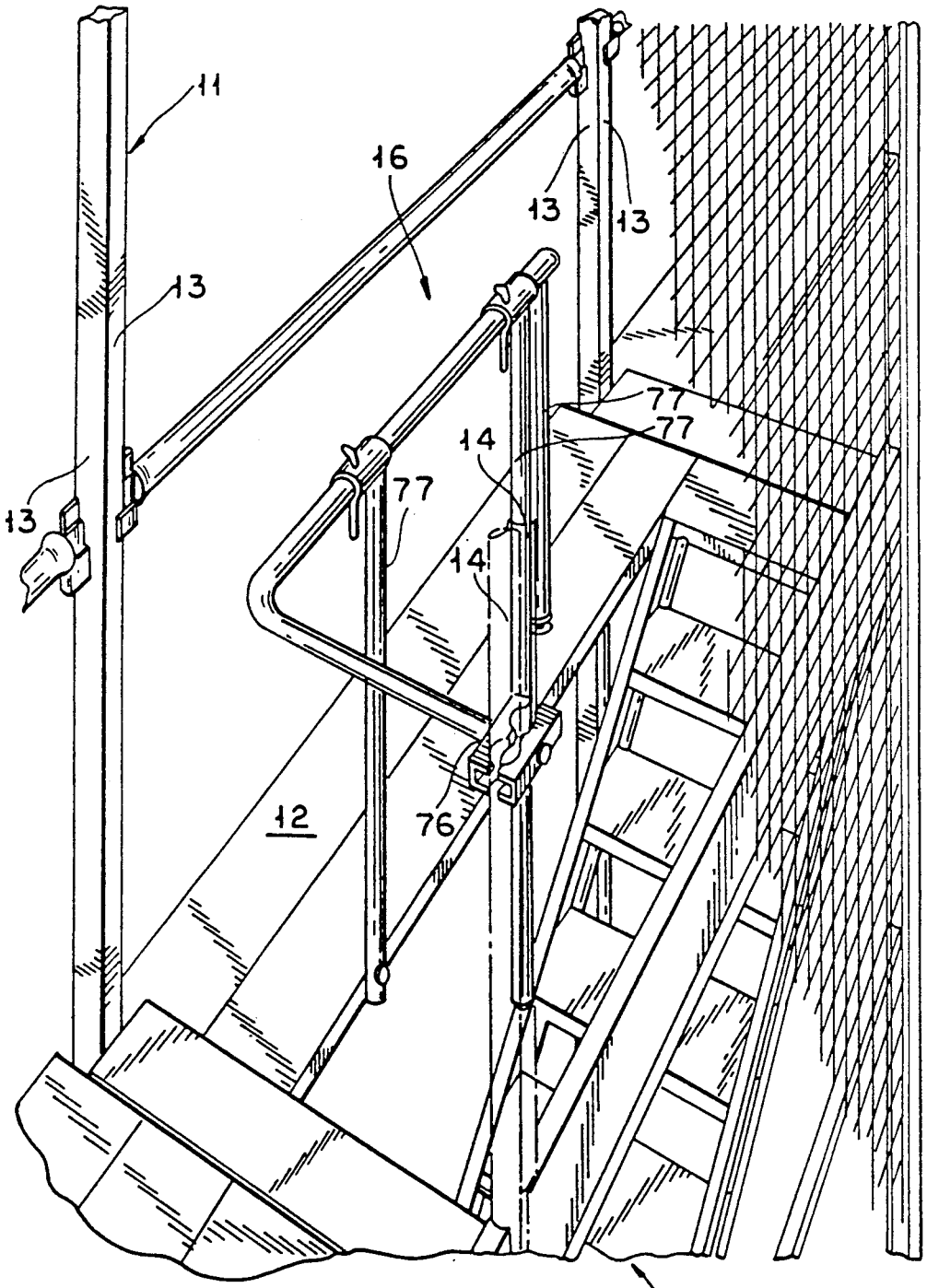
FIG. 6 is a schematic perspective view of a stair rail assembly employed in the scaffold of FIG. 1.
Figure 7:
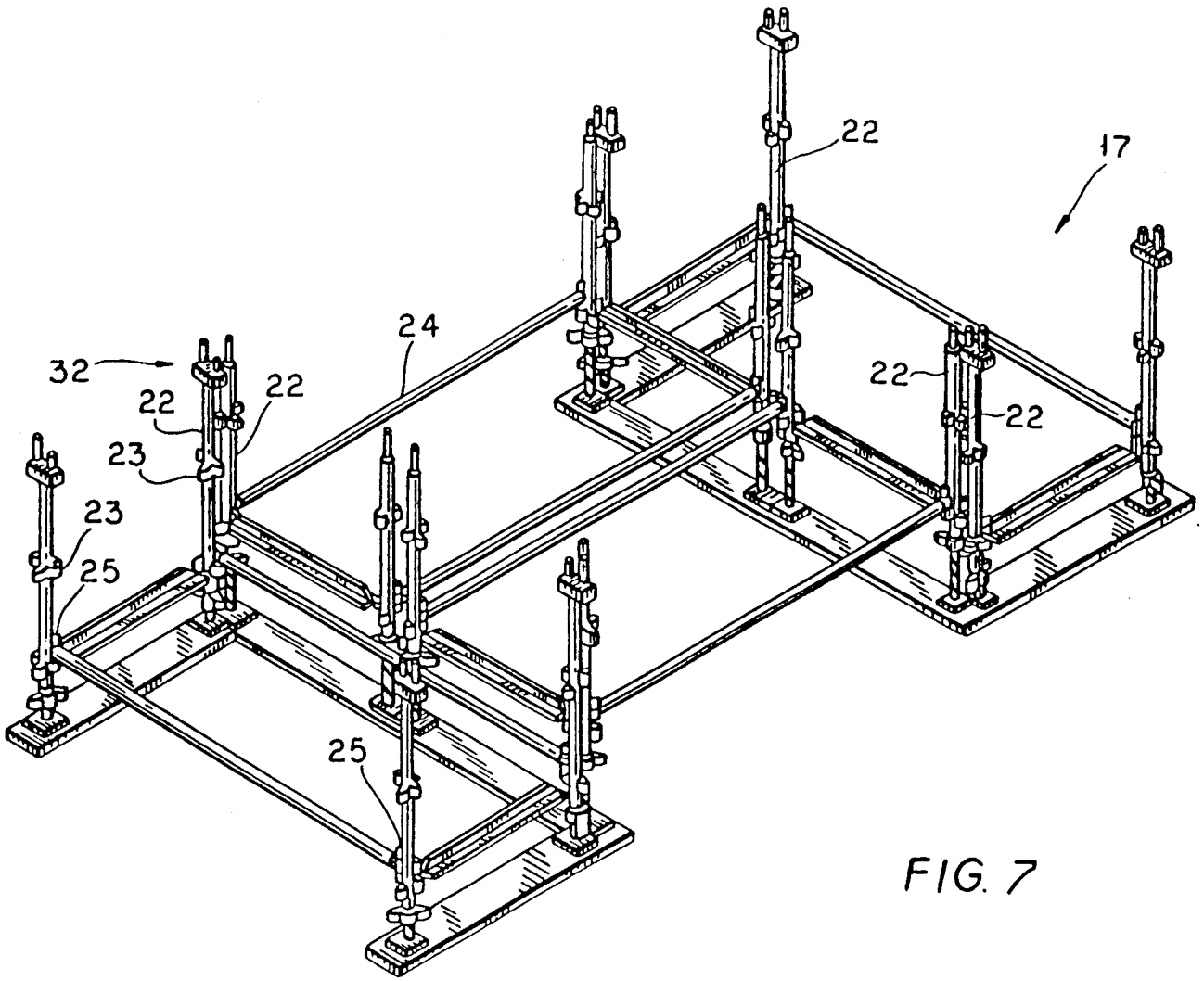
FIG. 7 is a schematic perspective view of a base assembly employed as scaffold of FIG. 1.
Figure 8:
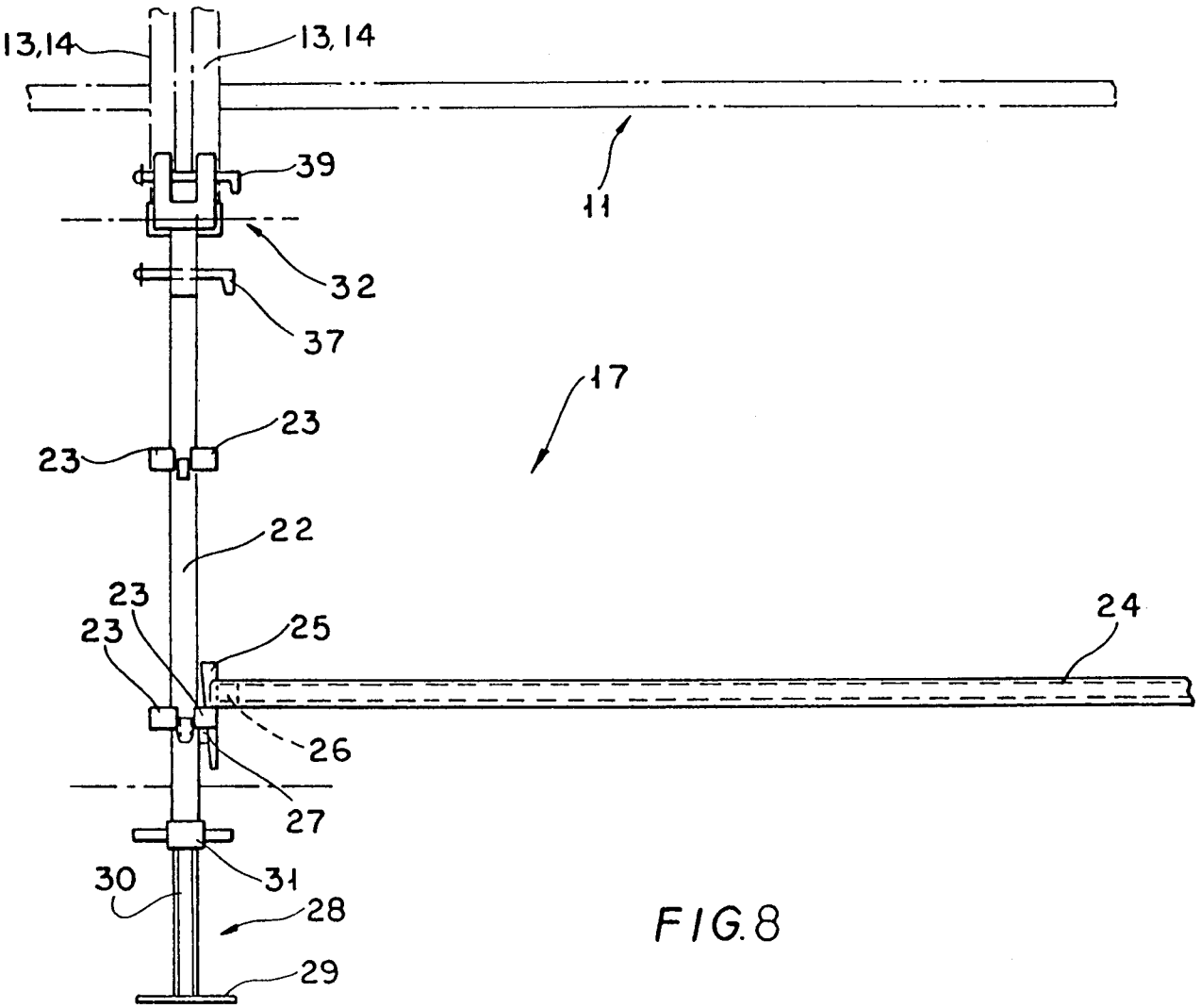
FIG. 8 is a schematic side elevation of a portion of the base of FIG. 7.

To provide access between the platforms 12 there is provided a set of stairs 15 passing through an aperture surrounded by a rail assembly 16 shown in FIG. 6. The stands 15 are to configurations. Firstly there is a stare module 140(4) which is a modified module 11. More particularly, the stand module 140 has an additional pair of columns 13 so that the overall module 140 is wider. The additional width is occupied by a flight of stairs 141 which extends between each adjacent pair of vertical platforms 12. The other form of the stair construction, is a further modification of the module 11. This particular modification is illustrated in FIG. 6. In this construction, a flight of stairs 142 extends between adjacent platforms 12 within the normal width of the module 11.

The modules are supported on base assemblies 17 partially shown in FIG. 7 to 10.

Figures 11, 12, 13, 14:
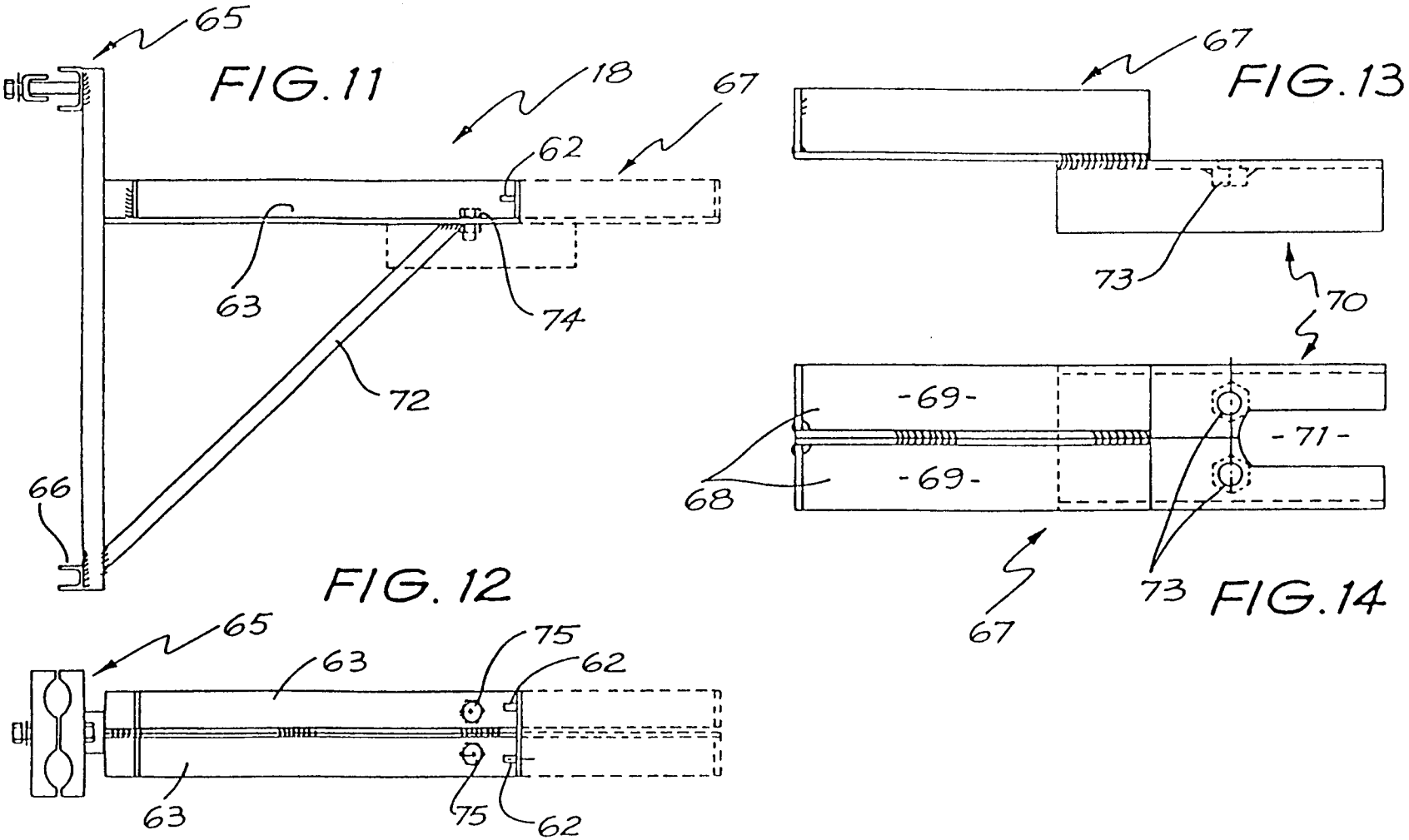
FIG. 11 is a schematic side elevation of a bracket employed in the scaffold of FIG. 1.
FIG. 12 is a schematic top plan view of the bracket of FIG. 11.
FIG. 13 is a schematic side elevation of an extension bracket for the bracket of FIG. 11.
FIG. 14 is a schematic top plan view of the bracket of FIG. 13.

The assembly 10 also includes a "hop up" bracket 18, and plank 60 therefor, which will be described with reference to FIGS. 11 and 14.

An access passage 19 is provided in the assembly 10, by means of a spur bracket 20 particularly described with reference to FIG. 17.

Figure 18:
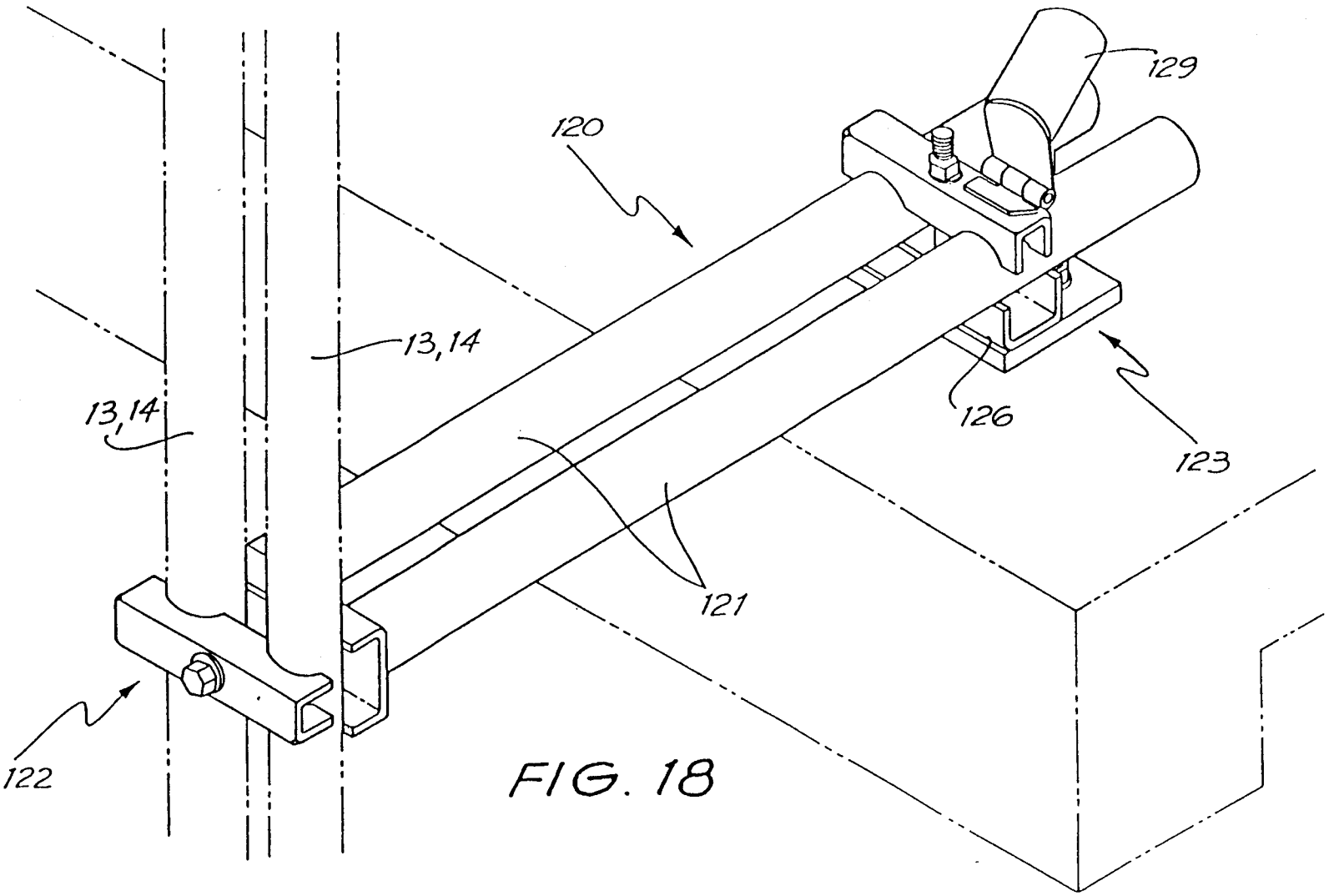
FIG. 18 is a schematic perspective view of a brace to anchor this scaffold of FIG. 1 to a building structure.
Figure 19:
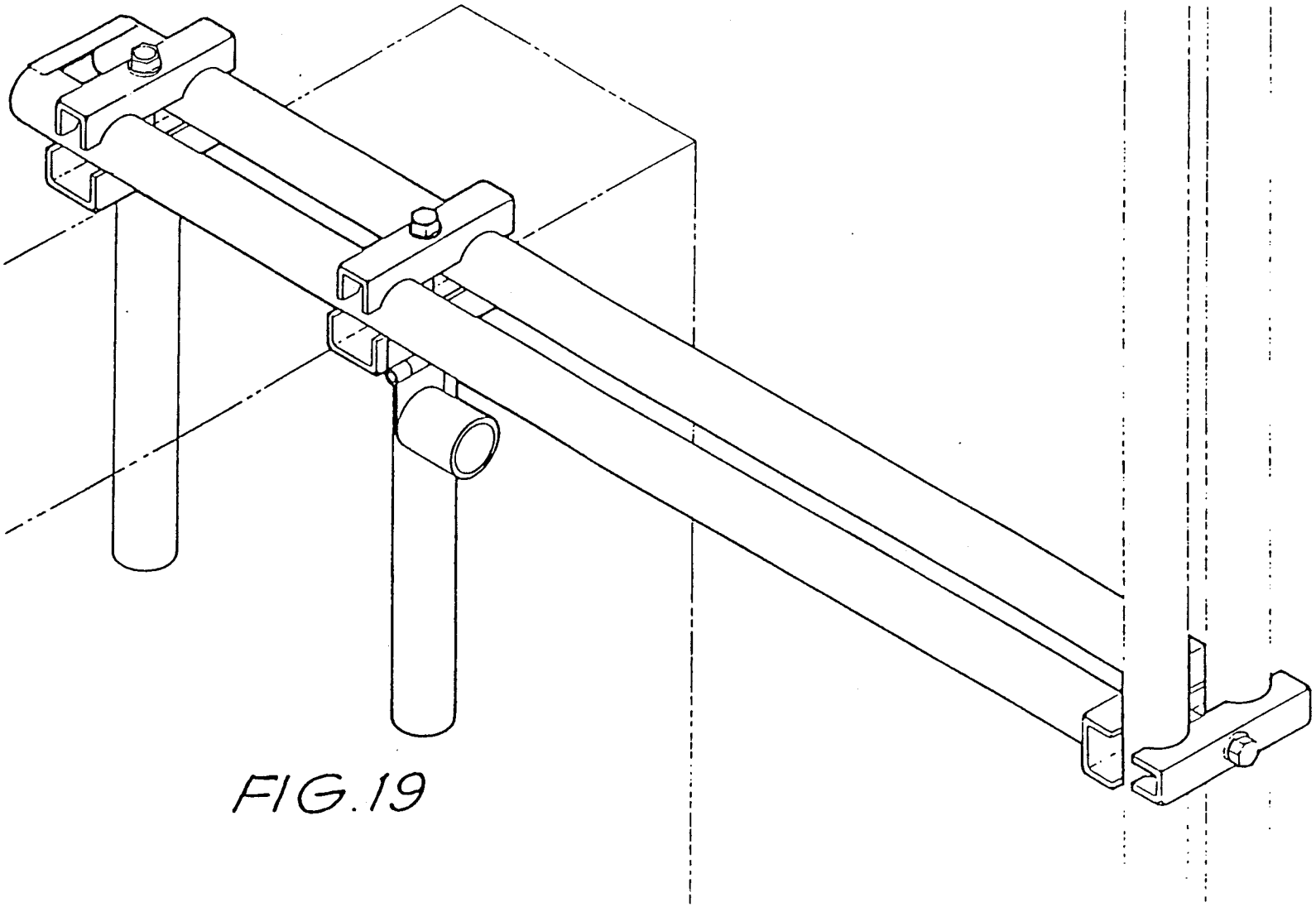
FIG. 19 is a schematic perspective view of a modification of the brace of FIG. 18.
Figure 20:
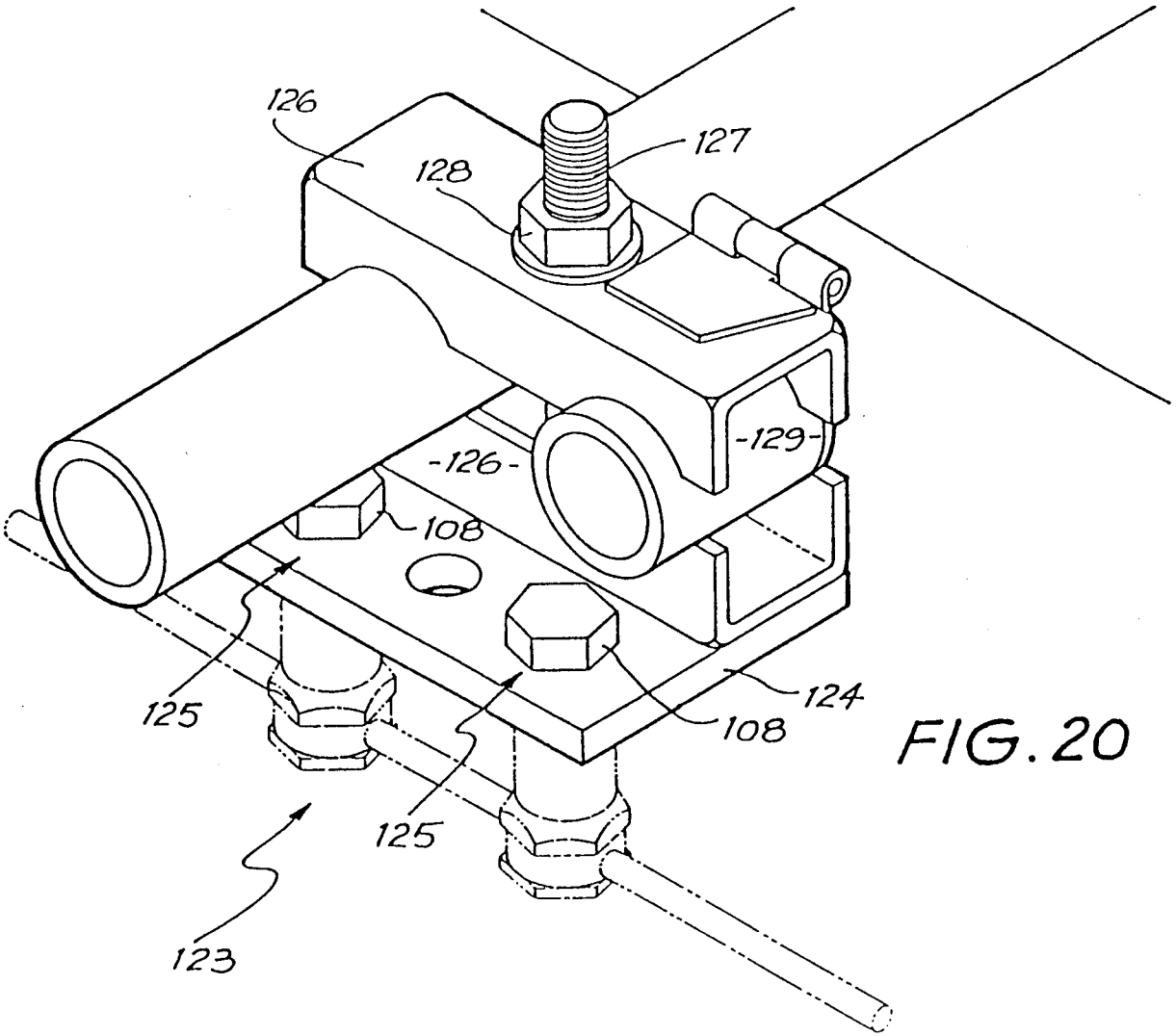
FIG. 20 is a schematic perspective view of a mounting assembly for the brace of FIG. 18.

The assembly 10 is secured to a building by means of braces described with reference to FIGS. 18 to 20.

In FIG. 7 to 10 there is schematically depicted a base assembly 17 as used in the scaffold assembly 10. The base assembly 17 includes a plurality of vertical columns 22 with sets of eyelets 23. The eyelets 23 engage horizontal braces 24 by means of wedges 25 passing through eyelets 26 at the end of each brace 24, and then entering the eyelet 23. The eyelet 23 is also provided with a wedge 27 which co-operates with the wedge 27 to secure the brace 24 in position. These particular wedges are of a known construction. Each column 22 is supported on a foot 28 having a foot plate 29 upon which there is mounted a hollow member 30. The member 30 telescopically receives the lower end of the column 22. Mounted on the upper end of the member 30 is a nut 31 which is rotatable about the longitudinal axis of the member 31, and threadably engages the lower end of the column 22. Rotation of the nut 30, causes vertical movement of the column 22 in order to enable the modules 11 to be correctly positioned.

Figure 9:
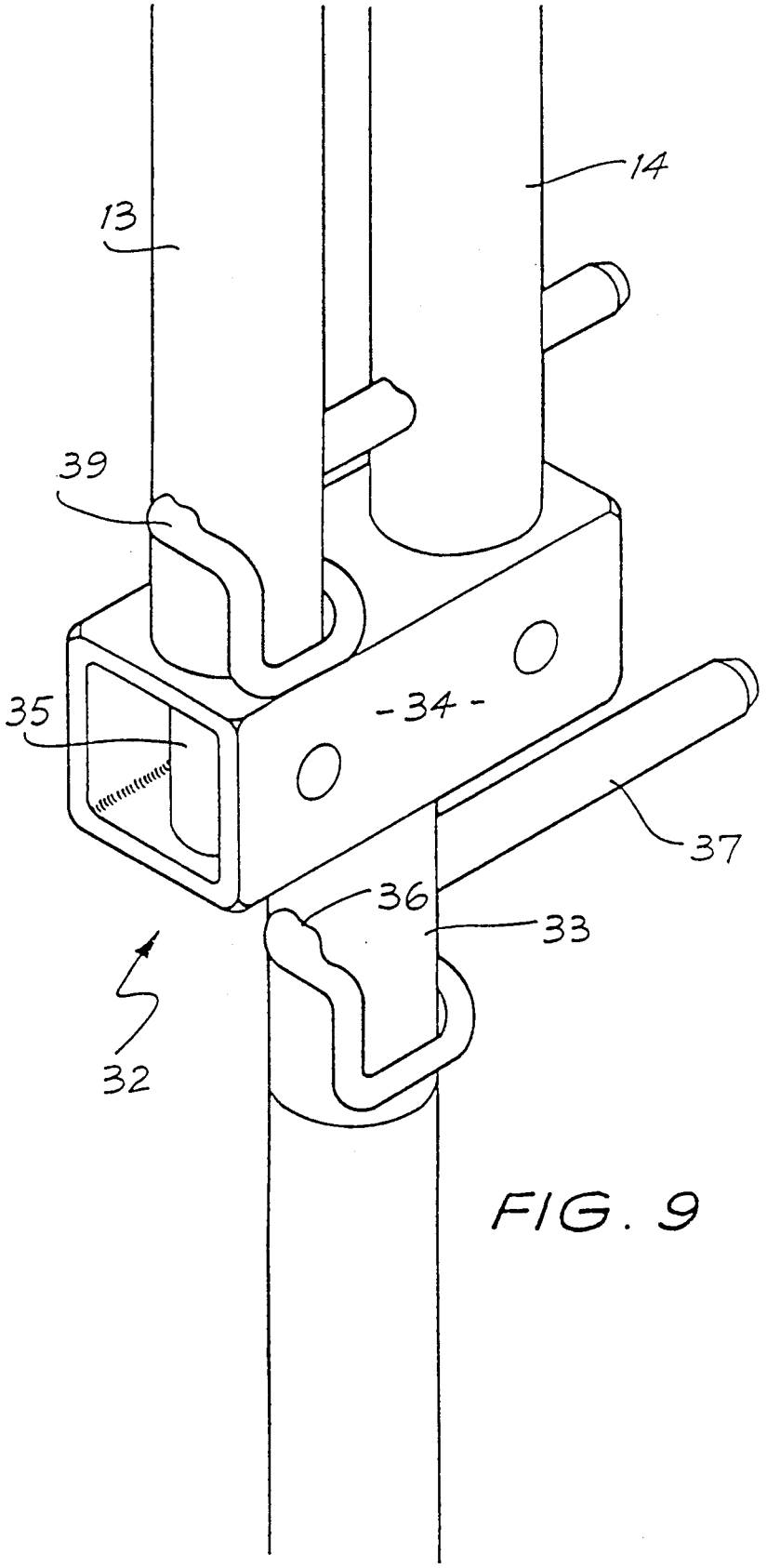
FIG. 9 is a schematic perspective view of a coupling employed in the base of FIG. 7.
Figure 10:
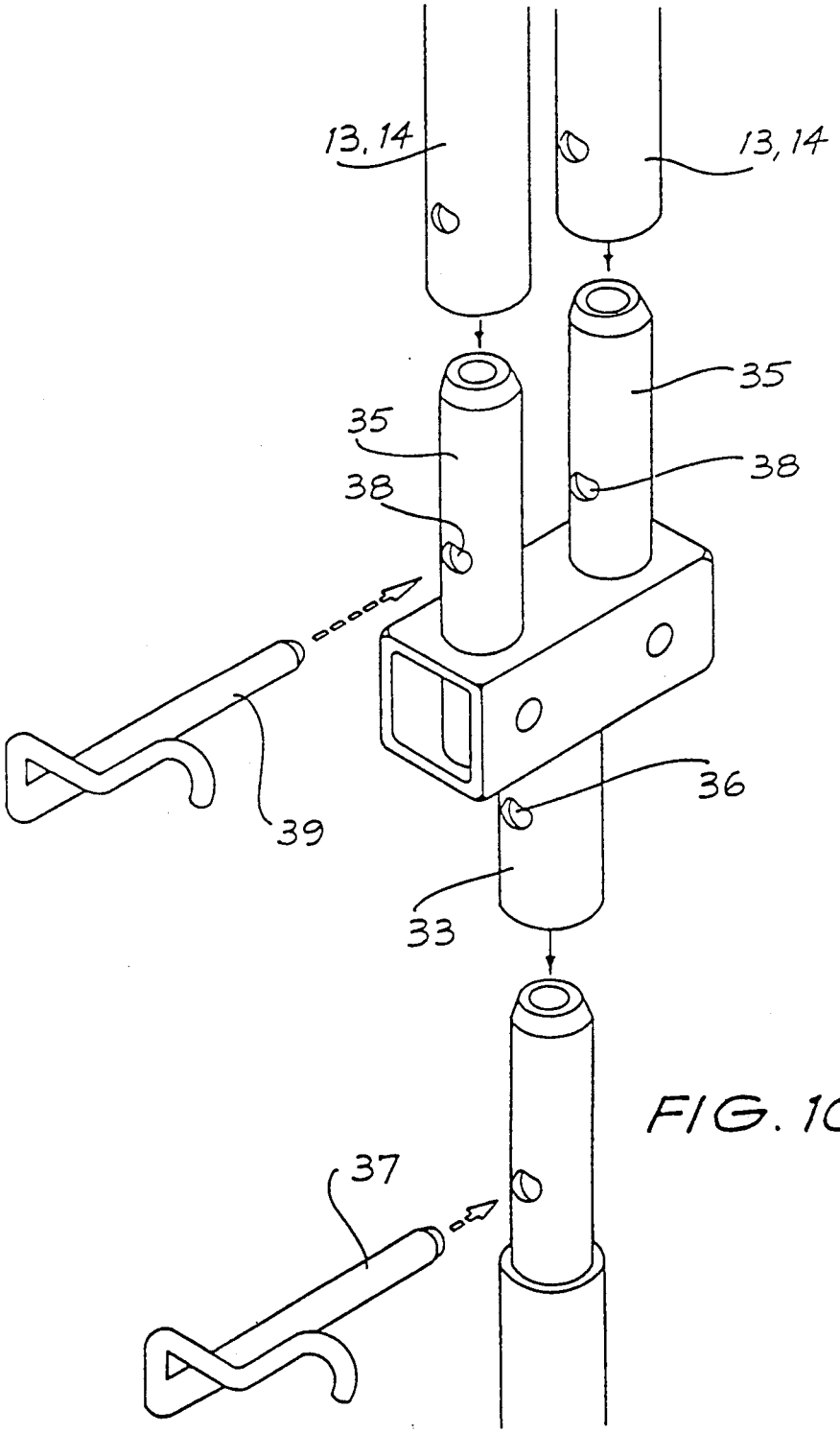
FIG. 10 is a schematic part exposed view of the coupling of FIG. 9.

The modules 11 are mounted on adaptors 32 shown in more detail in FIGS. 9 and 10. Each adaptor 32 includes a primary spiggot 33 which engages within the column 22. The spiggot 33, of tubular form, is attached to a base 34 from which there extends a pair of secondary spiggots 35. The spiggots 35 are received within the columns 13 and 14. The spiggot 33 is provided with a passage 36 through which a pin 37 passes, while the spiggots 35 are provided with aligned passages 38 through which a pin 39 passes. The pin 39 also passes through aligned passages in the lower ends of the columns 13 and 14.

Figure 15:
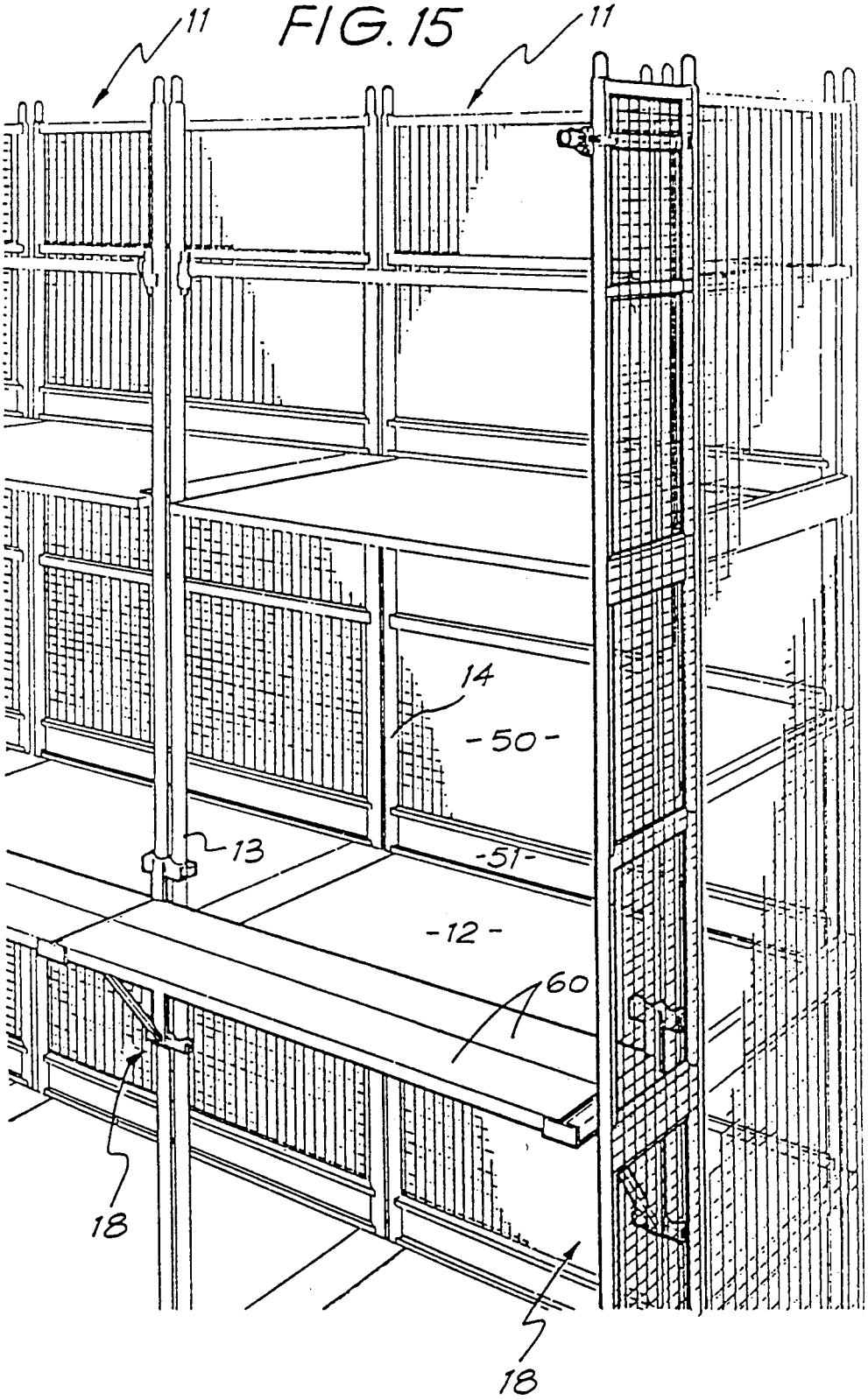
FIG. 15 is a schematic perspective view of a portion of the scaffold of FIG. 1, employing the bracket of FIG. 11.
Figure 21:
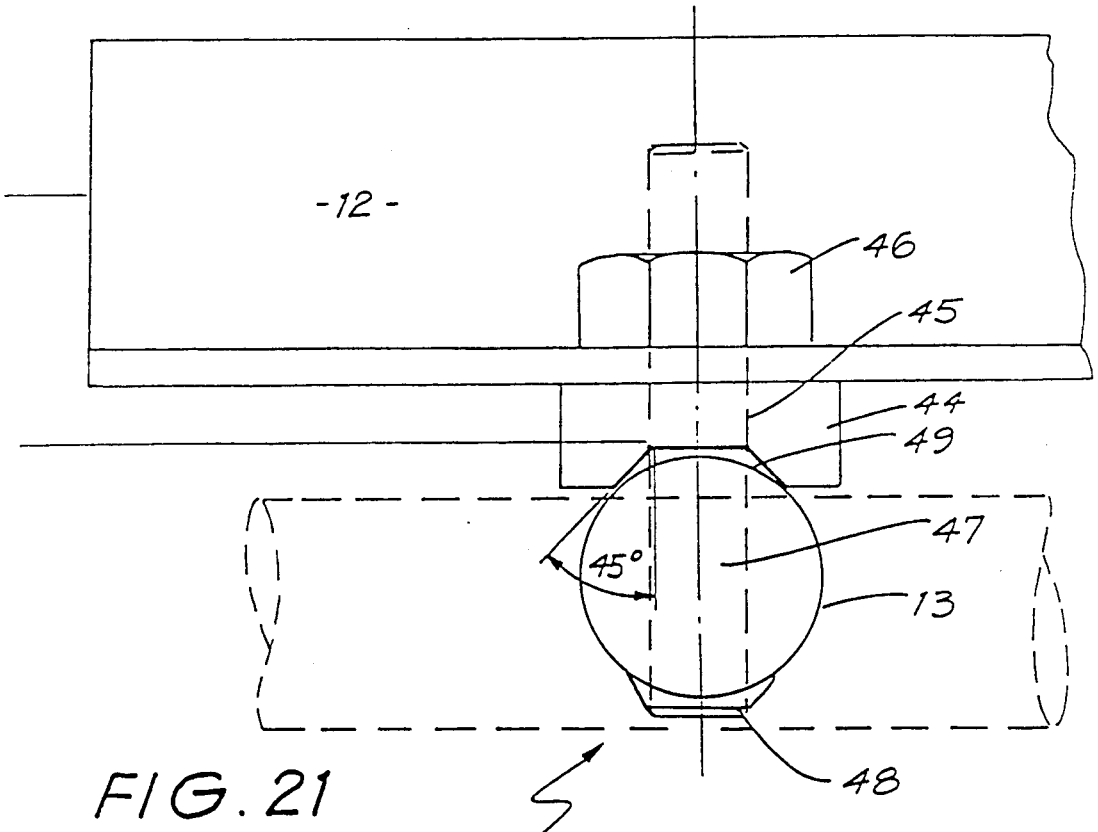
FIG. 21 is a schematic top plan view of a pivot assembly employed in the modules of FIG. 1.
Figure 22:
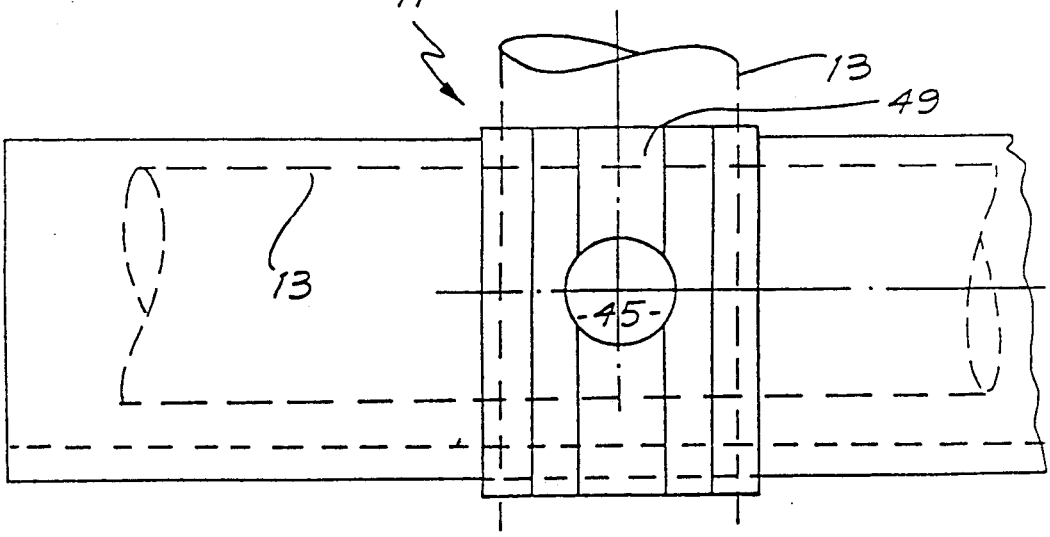
FIG. 22 is a schematic side elevation of the pivot assembly of FIG. 21.
Figure 25:
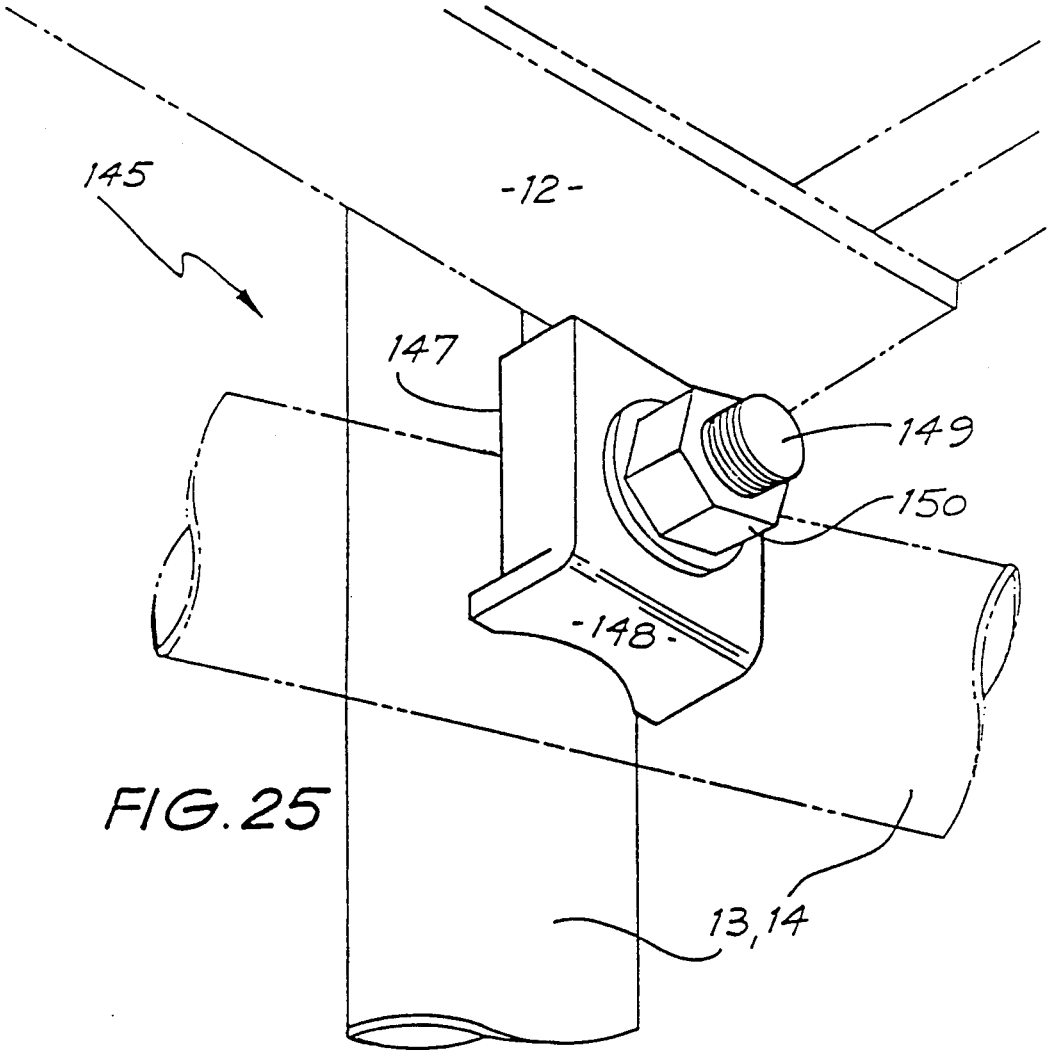
FIG. 25 is a schematic perspective view of the pivot assembly of FIG. 23.
Figure 30:
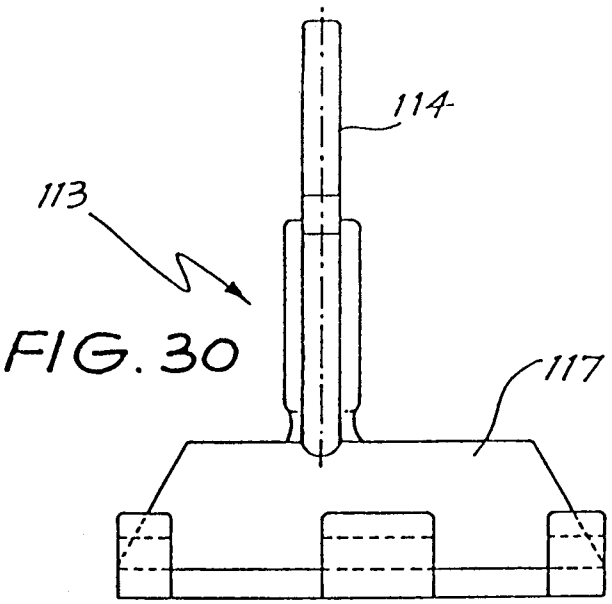
FIG. 30 is a schematic front elevation of a hook employed with the crane of FIG. 7.
Figure 31:
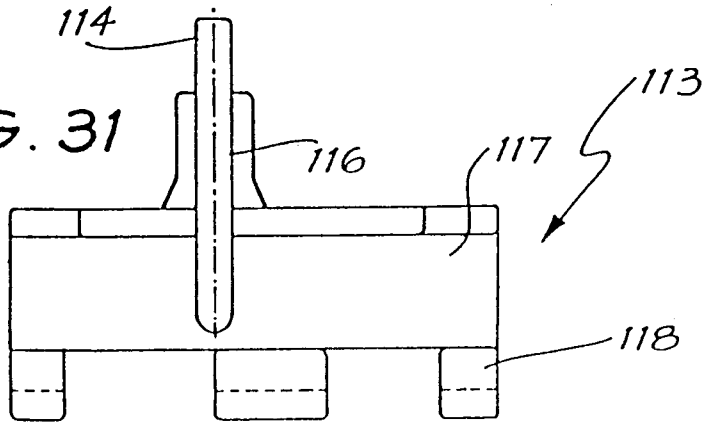
FIG. 31 is a schematic top plan view of the hook of FIG. 30.
Figure 33:
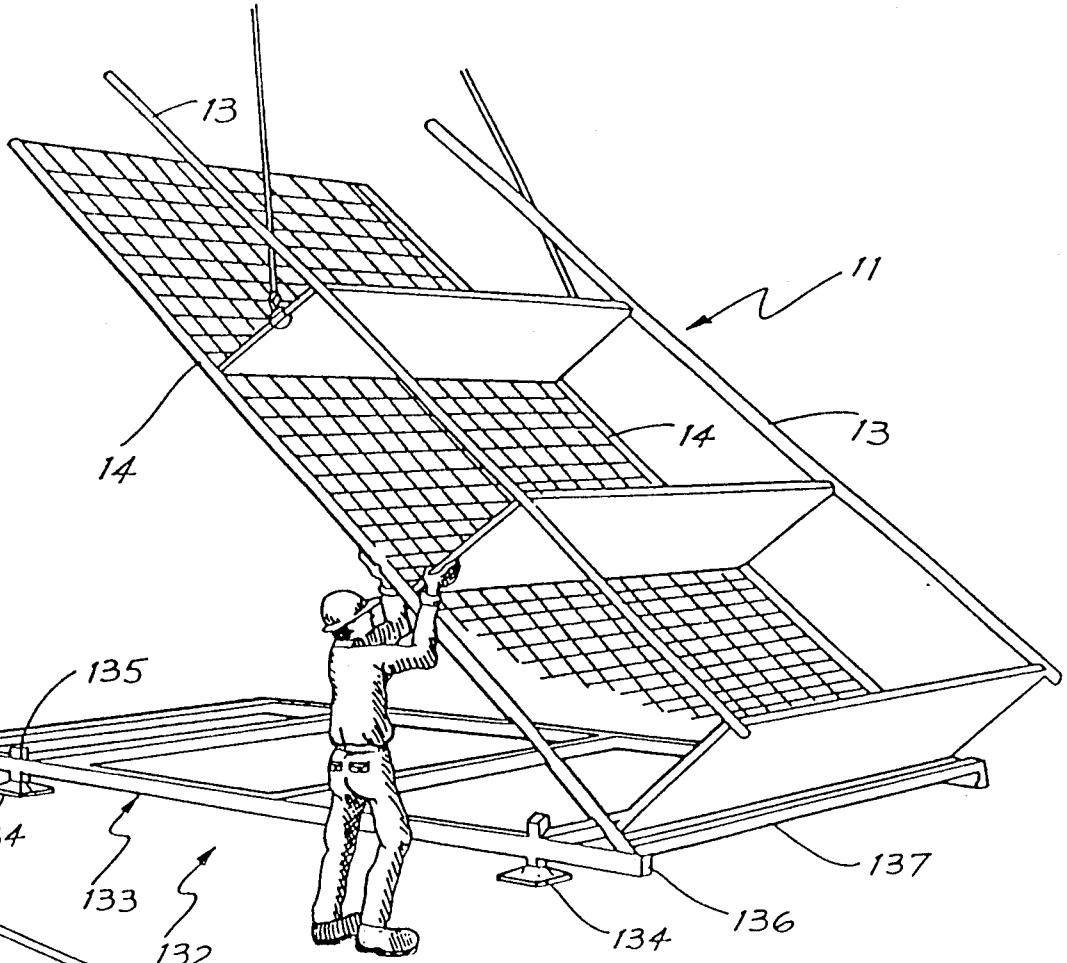
FIG. 33 is a schematic perspective view of a module and pallet upon which the modules are stacked.
Figure 34:
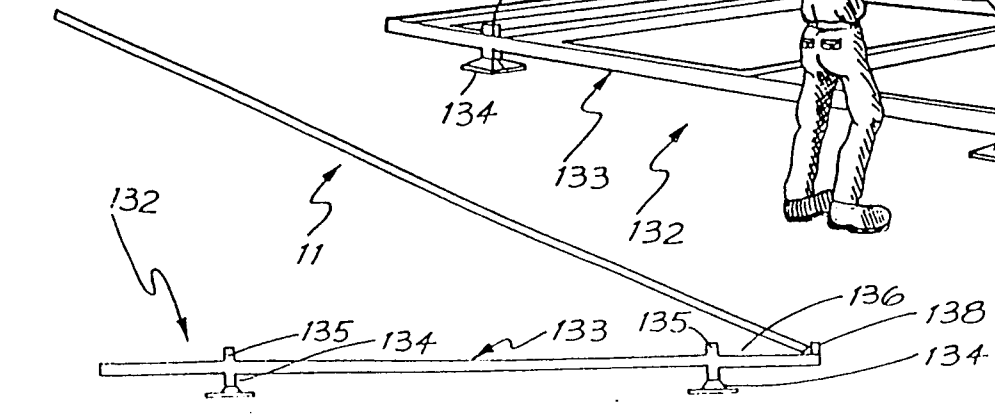
FIG. 34 is a schematic side elevation of the pallet of FIG. 33.

Each module 11 includes a plurality of platforms 12, which are pivotally attached to the columns 13 and 14 by means of pivot assemblies 40 and 41 FIGS. 21 and 25). Each column 13 is pivotally attached to its associated platforms 12 by pivot assemblies 41, while each of the columns 14 is pivotally attached to its associated platforms 12 by means of pivot assemblies 40. It should be appreciated that each pivot assembly 40 includes a link 42 provided with a passage 43 through which a bolt passes to pivotally attach the link 42, and therefore the platform 12 to the column 14. The pivot axis is spaced vertically below the platform 12. In the case of the pivot assemblies 41, as seen in FIGS. 30 and 31, includes a clamp member 44 having a passage 45 through which a bolt, such as shown in FIGS. 14 or 15, passes to engage a nut 46 engaging the platform 12. The bolt 47 has a concave head 48 which fits the circular contour of the column 13.

Figure 23:
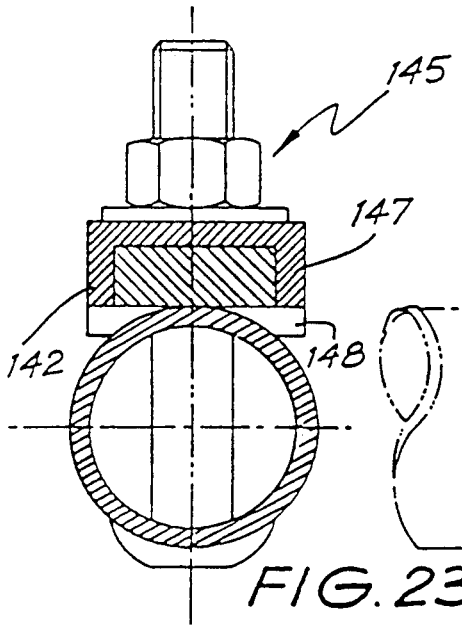
FIG. 23 is a schematic section and elevation of an alternative pivot assembly to that of FIG. 21.
Figure 24:
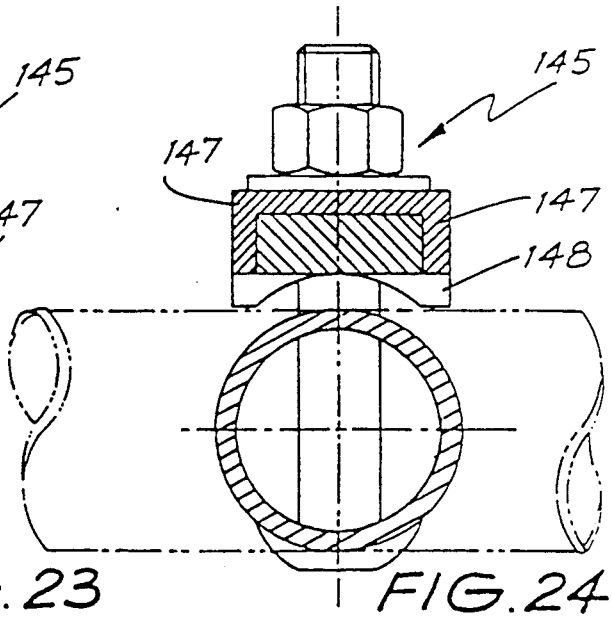
FIG. 24 is a schematic end elevation of the pivot assembly of 23.

In FIGS. 23 to 25, there is schematically depicted an alternative pivot assembly 145, to the pivot assembly 41 or 42. The pivot assembly 145 includes a base portion 146 which is of channel configuration so to have a pair of longitudinal sides 147. An end portion 148 of the channel is bent so to be positionable to engage the column 13 or 14. More particularly, in portion 148 is profiled so as to fit snugly against the column 13 or 14. The pivot assembly further includes a bolt 149 and nut 150 which is tensioned to clamp the platform 12 in position relative to its column 13 or 14.

The clamp member 44 has a shaped recess 49 within which the column 13 is located to prevent pivoting of the column 13 relative to the platform 12 once the bolt 47 has been tensioned by rotation of the nut 46.

The pivoting axis defined by the pivot assemblies 40 and 41, are not located in the same horizontal plane. More particularly the pivoting axis defined by the pivot assembly 40 is lower than the pivoting axis defined by the pivot assembly 41. This arrangement enables each module to be folded as discussed in the Australian patent application referred to in the introductory portion of this specification.

Preferably each module 11 includes three platforms 12 and associated pivot assemblies 40 and 41. It is also preferably that there is extending between each pair of columns 14 a mesh panel or panels 50 to act as a safety screen, and to provide each module with the required degree of rigidity. If so required kick boards 51 may also extend between each pair of columns 13 and 14.

Each platform 12 is provided with a joining plate assembly 141 which enables the secure joining of adjacent platforms 12 of adjacent modules. Each assembly plate 141 includes a base plate 52 and a plurality of hinges 53, which hinges 53 are secured to the platform 12. The base plate 52 is also provided with two or more projections 54 which engage within corresponding recesses 142 in the adjacent platform 12 to which it is to be attached. The projections 54 aid in aligning the passages 55 of the platform 12 with passages 143 in the base plate 52, so that bolts may be positioned therein to secure each base plate 52 to its associated adjacent platform 12.

Where a module 11 forms a corner or end of the scaffold assembly 10, such as the module 11(A), an end screen 144 is provided to close the end aperture of the module 11(A) (FIG. 2). The end screen 144 has a pivoted plate 56 which closes the opening between the end screen 144 and the platform 12. Bolts 57 secure the plate 56 in position. A hinge 58 pivotally connects the plate 56 to the main body of the end screen 144.

It is desirable in some instances to provide an extension of each platform 12, particularly if that extension can be at a higher level than the platform 12. To this end, the bracket 18 is provided (FIGS. 11 to 13). The bracket 18 receives a "hop up" planks 60. The plank 60 has a pair of apertures 61 which engage pins 62 of the bracket 18. This ensures retention of the planks 60 in position and inhibits them from accidental removal. The plank 60 extends between a pair of brackets 18 and is retained by a seat 63 of each bracket. The brackets 18 are provided with a pair of seats 63 and a pair of pins 62 so that each bracket 18 can support adjacent ends of adjacent planks 60. The brackets are provided with clamp assemblies 65 which engage the columns 13, while a U-shaped member 66 engages the edge of the platform 12.

It is desirable to be able to extend the plank 60. Accordingly there is provided an extension bracket 67. The extension bracket 67 has a seat portion 68 providing two seats 69 to engage extension planks. A base portion 70 has an aperture 71 enabling the bracket 67 to pass around a strut 72 of the bracket 18. A pair of nuts 73 are fixed to the bracket 67 and engage bolts 74, which pass through apertures 75 to secure the bracket 67 to the bracket 18.

The rail 16 (FIG. 6) has a clamp 76 to engage a pair of adjacent columns 13 or 14, and has a pair of vertical members 77 which engage the platform 12. If no required one of the members 77 can be provided with a T piece which engages between a pair of adjacent platforms 12.

To join adjacent platforms 12, which are angularly inclined, there is provided a radius plate 79 (FIG. 25), the radius plate 79 has fringe portions 80 which overlap the adjacent platforms 12, or an adjacent plate 79. Bolt holes 81 enable adjacent plates 79 to be secured together or alternatively to be secured to adjacent platforms 12.

Figure 4:
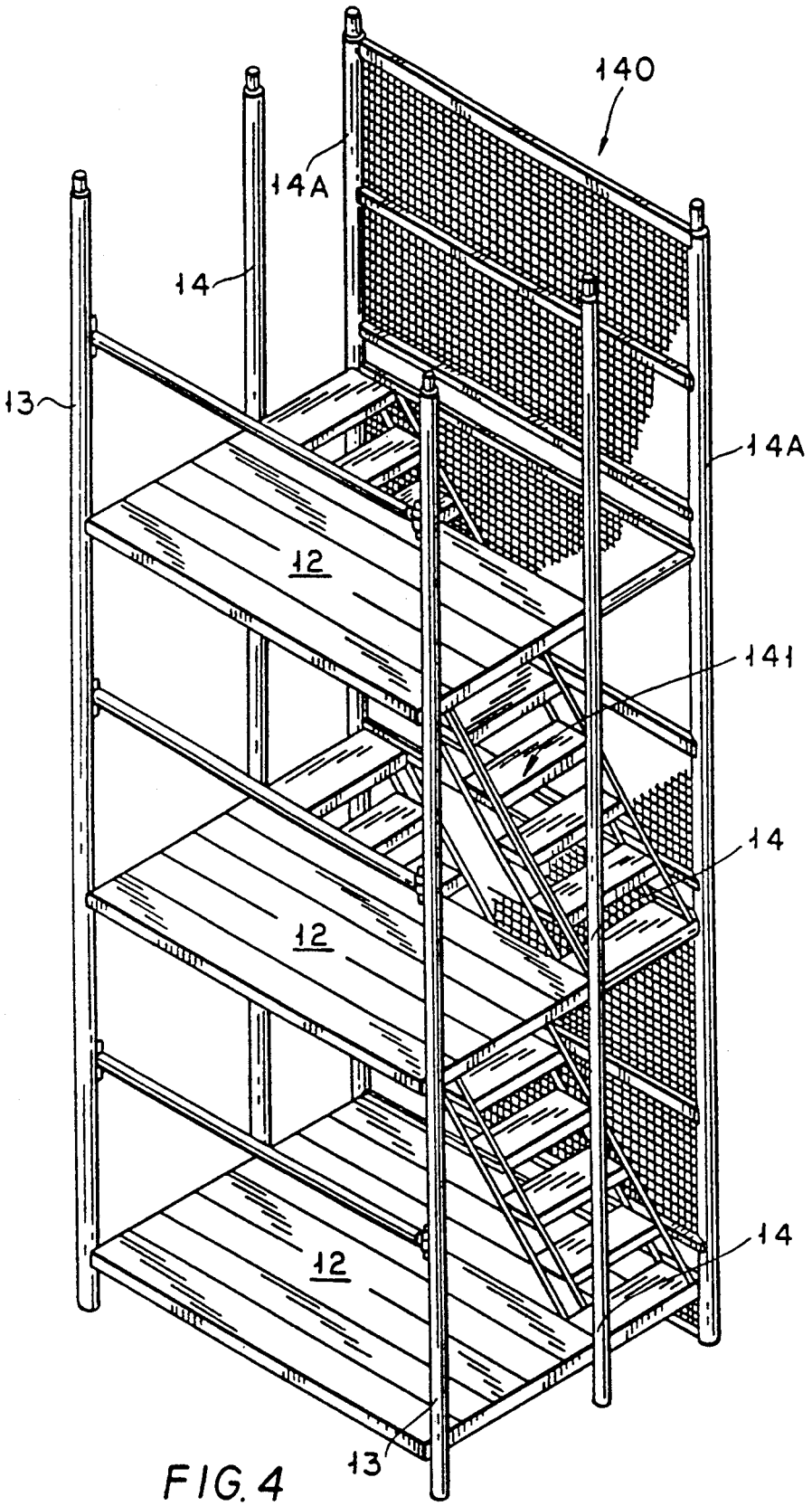
FIG. 4 is a schematic perspective view of a scaffold module employed in the scaffold of FIG. 1.
Figure 17:
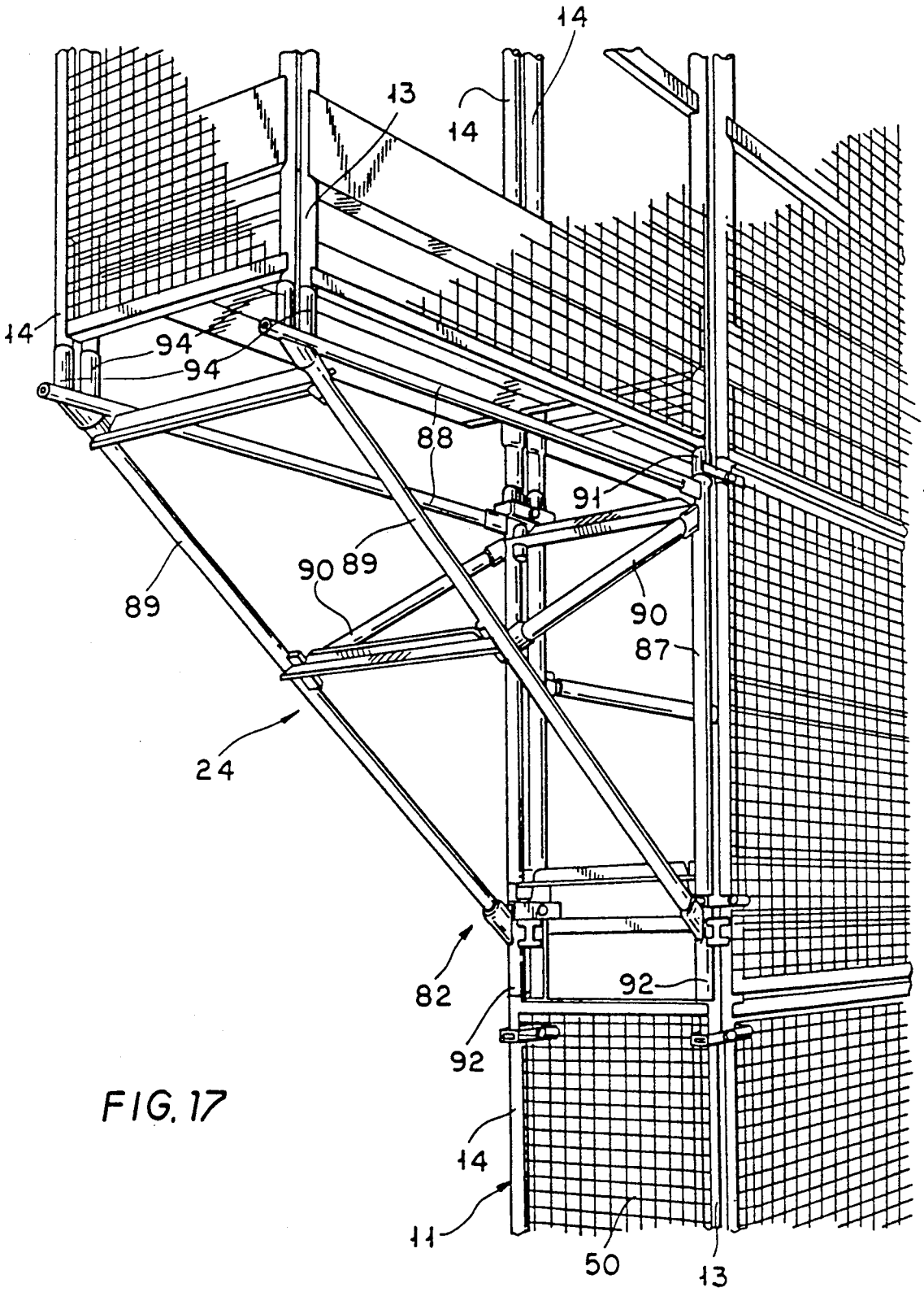
FIG. 17 is a schematic perspective view of a brace employed in the scaffold of FIG. 1.

In FIG. 17 a scaffold assembly 82 is shown with braces 24 extending horizontally from a modules 11. In FIG. 4, the brace 24 enables the scaffold assembly 84 to be extended horizontally so as to provide an "overhang" 86 or passage 19.

The bracket 24 includes a pair vertical posts 87 and a pair horizontal members 88 joined by a pair of diagonal members 89. A further pair of diagonal members 90 is provided. The each post 87 is provided with an upper spiggot 91 which is telescopically received within the vertical column 13 or 14 of the module 11 above the bracket 24. The lower end of the post 87 has a hollow spiggot 92 which engages a projection 138 (FIG. 5) which extends to the adaptor 23 to engage one of the pins 35. The horizontal member 88 has a pair of spiggots 94 which engage a pair of vertical columns 13 or 14 of the modules 11 placed above the bracket 20.

In FIG. 1 there is schematically depicted a scaffold assembly 95. The scaffold assembly 95 employs modules 11 as previously discussed however, in this particularly instance a series 97 of the modules 11 is provided, without the modules 11 having platforms 12. Accordingly a duct 98 is provided which extends to adjacent ground level. The duct 98 has access openings, each provided with a pivoted door. The duct 98 enables refuse and other material to be delivered via a chute 101 to a storage (transportation) bin 102.

The modules 11 may also be modified to provide a lift module 103 (FIG. 1) provides a vertically extending duct 104 through which a lift 105 may pass. The lift could be driven by means of a rack and pinion assembly.

The bracket 20 is also usable to establish an outwardly extending platform 106 which may be used in conjunction with a crane.

Figure 26:
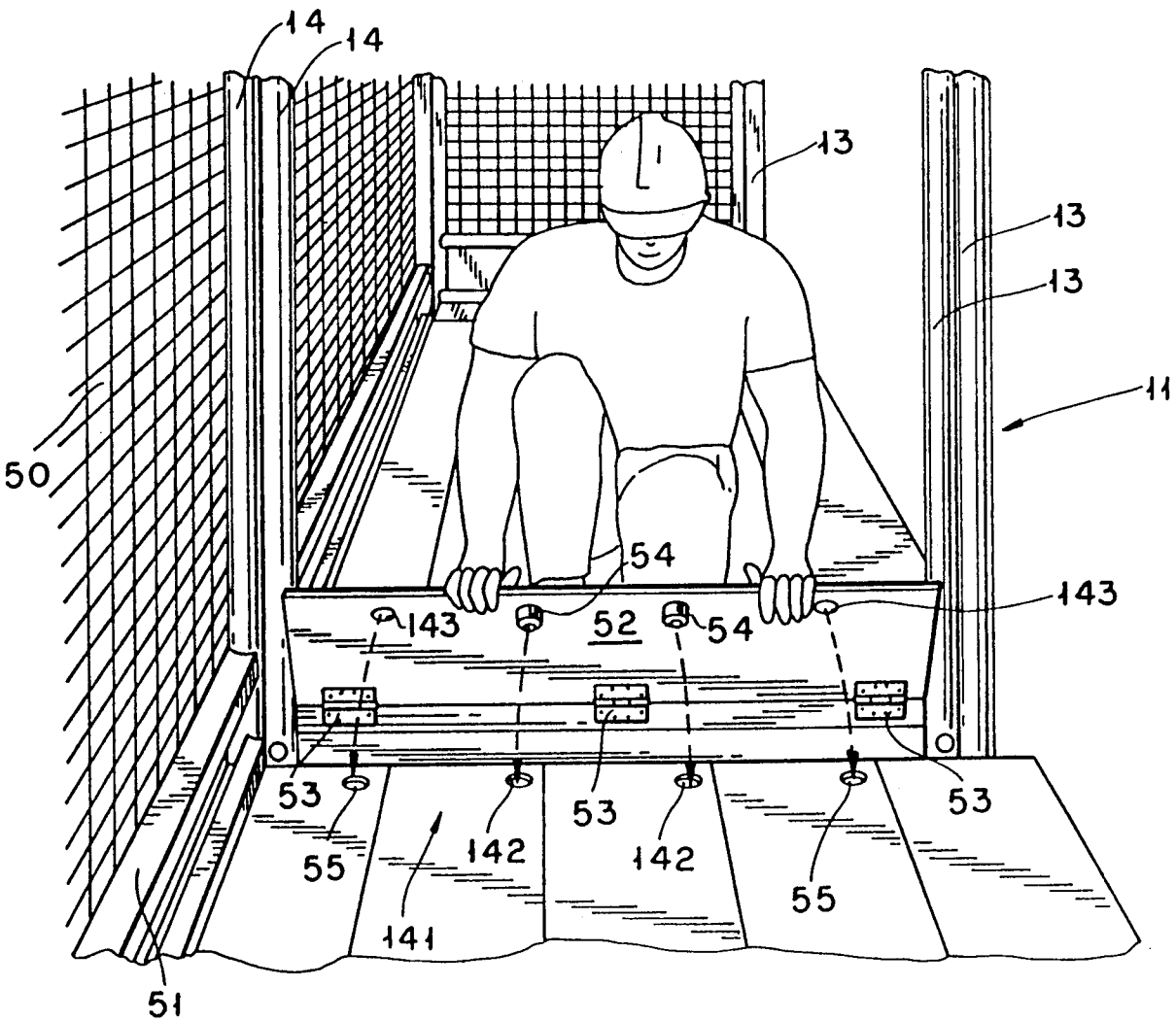
FIG. 26 is a schematic perspective view of a pair of adjacent modules being coupled together by a joining plate.

In FIG. 26, there is schematically depicted a means of constructing a scaffold assembly as previously described. In this particular instance, a pair of crane 107 are used to lift each module into position. The crane 107 can raise and position a module 11 until the row of modules 11 is completed. The crane is then moved to complete the next row.

Figure 27:
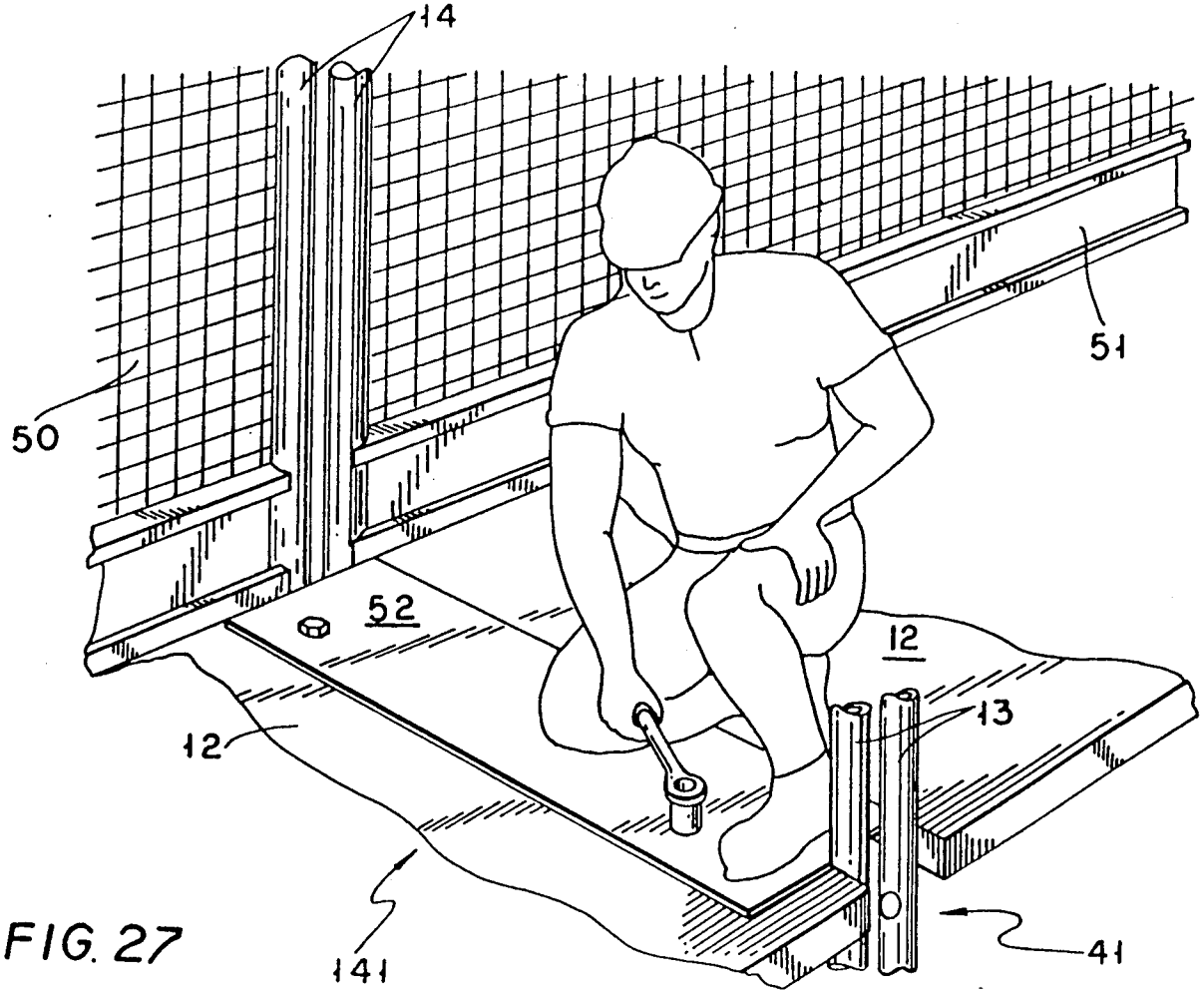
FIG. 27 is a schematic perspective view of the modules and plate of FIG. 26.
Figure 28:
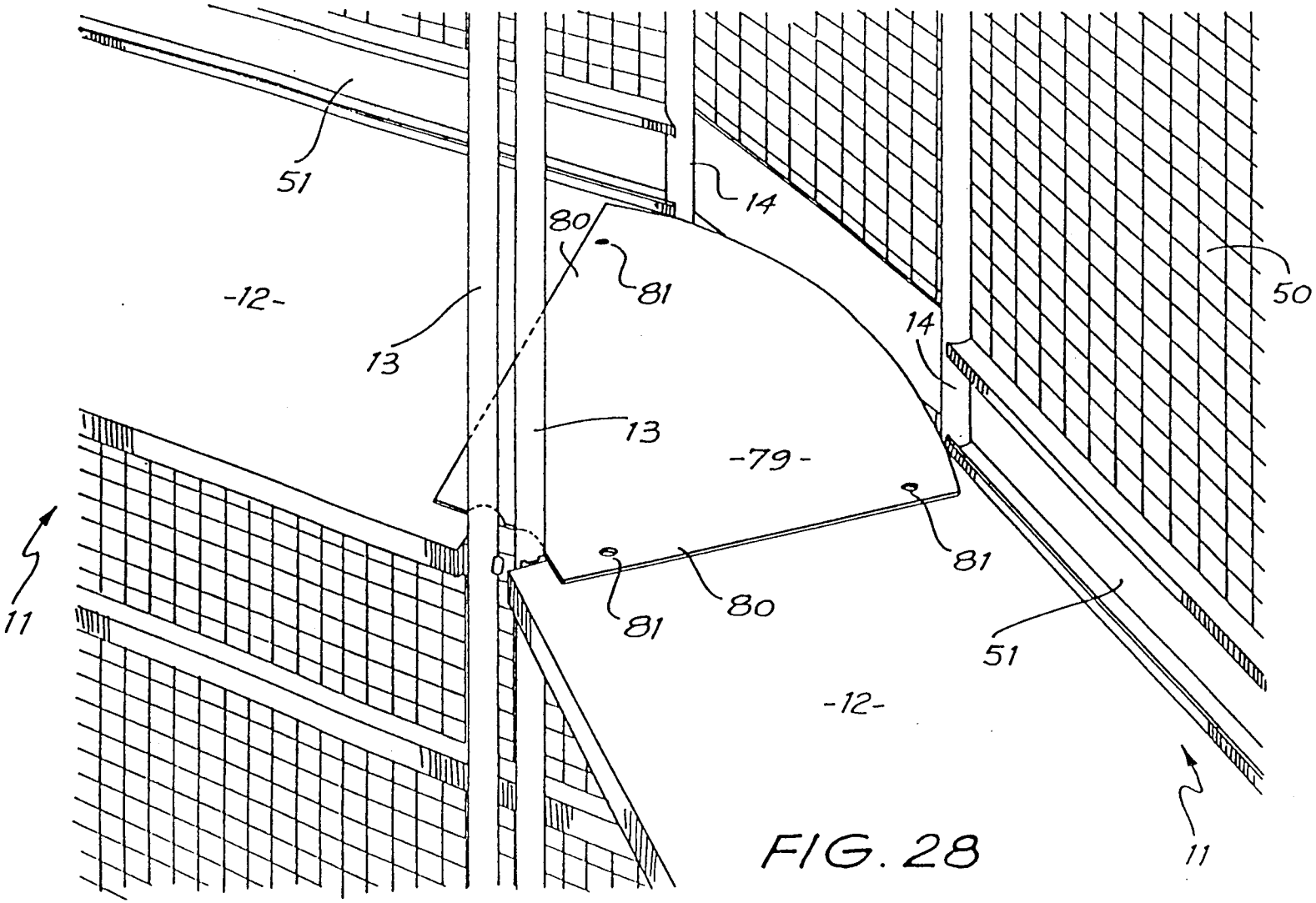
FIG. 28 is a schematic perspective view of a joining plate by pair of adjacent modules which are angularly displaced.
Figure 29:
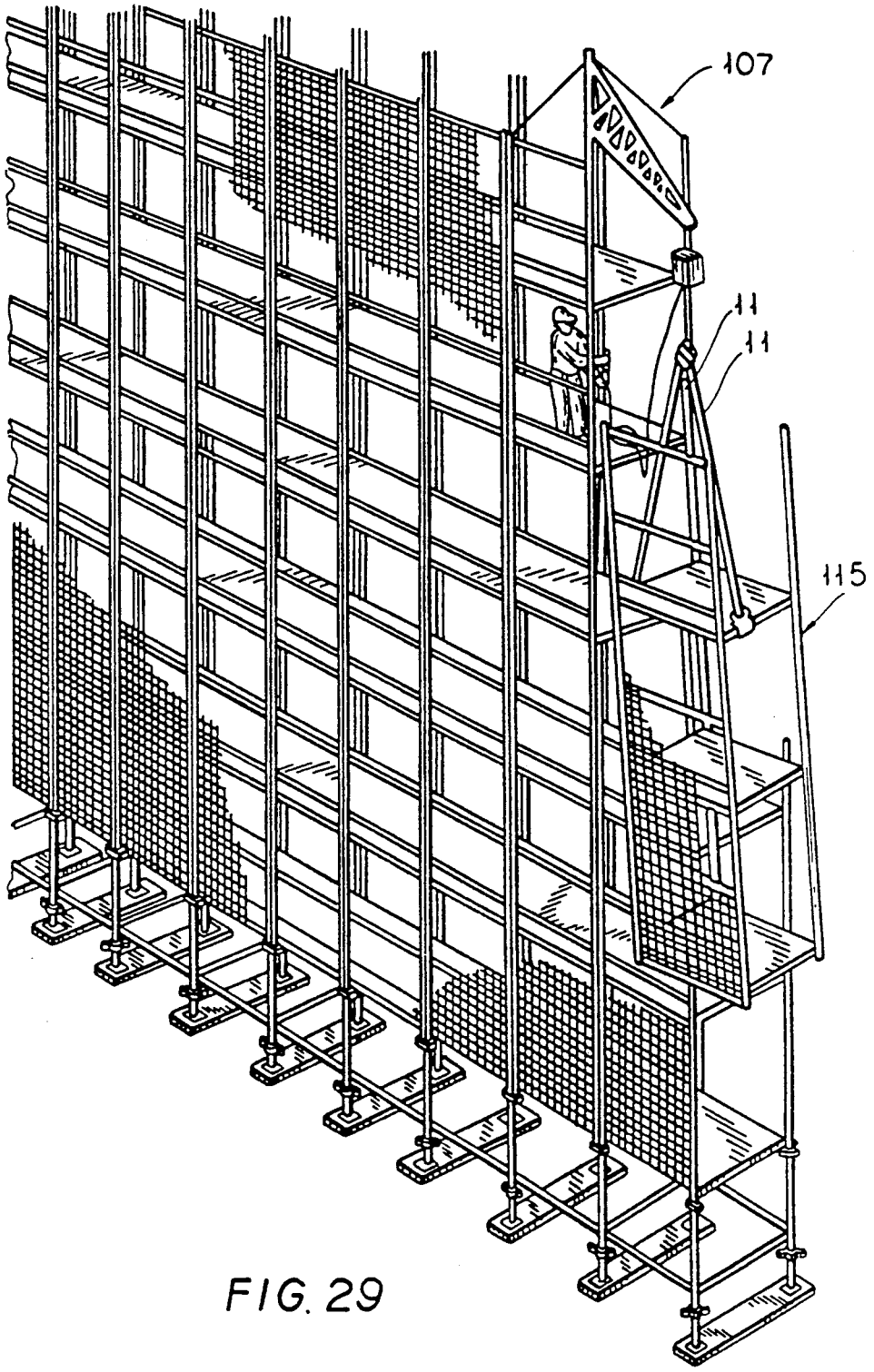
FIG. 29 is a schematic perspective view of a crane employed to erect the scaffold of FIG. 1.
Figure 32:
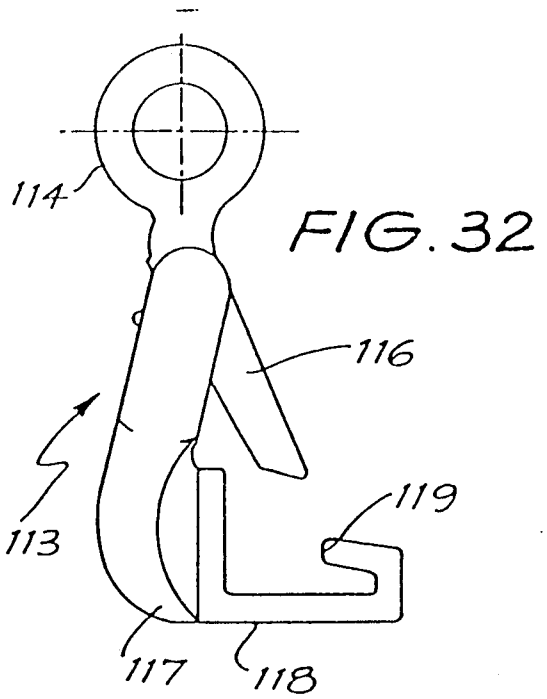
FIG. 32 is a schematic end elevation of the hook of FIG. 30.

Preferably the cranes 107 would employ a hook 113 as shown in FIGS. 27 to 29. The hook 113 includes an eyelet 114 to engage the cable crane 115. The eyelet 114 has extending from it a retaining projection 116, to which there is pivotally attached a cradle 117. The cradle 117 has a channel portion 118 having a return lip 119. The channel portion 118 is adapted to engage a channel section which is used along the two longer edges of each platform 12.

Figure 16:
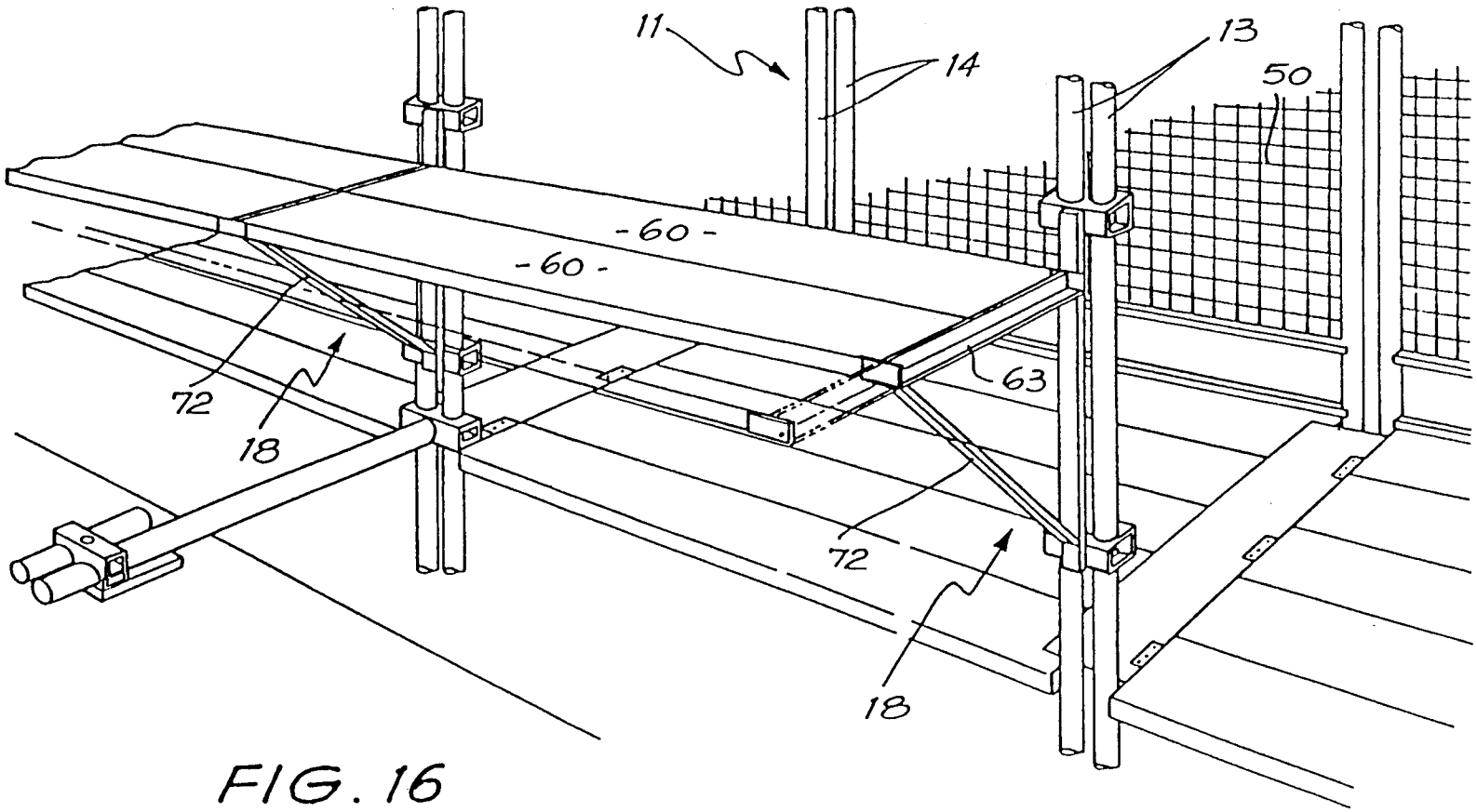
FIG. 16 is a schematic perspective view of the bracket of FIG. 11.

In FIGS. 15 to 17, there is depicted various braces which secure the scaffold assembly to a building structure. In FIGS. 46 and 47 there is schematically depicted a brace 120 which includes a pair of elongated brace members 121. The brace members 121 are adapted to be attached to a pair of columns 13 or 14 by means of a clamp assembly 122. The brace members extend to a mounting plate assembly 123 (FIG. 17) which is secured preferably to a concrete floor of the building structure. The assembly 123 includes a base plate 124 with passages 125 through which securing bolts 108 pass. The assembly 123 further includes a pair of co-operating clamp members 126 which are bought together by means of a bolt 127 and a nut 128.

In FIG. 17 a single elongated brace member 121 extending to a clamp assembly 123. In such an instance a "dummy" sleeve 129 is pivoted into place to replace the other member 121.

In FIGS. 30 and 31 there is schematically depicted a pallet 132 to transport a plurality of modules 11. The modules 11 are initially in a folded configuration and are stacked on the pallet 132. When one of the modules is to be raised to a scaffold assembly, the platform 12 is gripped by means of the hook 113 of FIGS. 27 to 29 and lifted. The module 11 then unfolds and the pivot assembly 41 tensioned to retain it in its unfolded configuration. Thereafter, the module 11 is positioned and stacked on the previously established modules.

The pallet 132 includes a generally rectangular base 133 from which there extends feet 134. Projections 135 aid in retaining the lowermost module in position. The base 133 has an extension portion 136 with a stop member 137 against which the modules 11 slidably abut when being positioned on the pallet 132.

I claim:

1. A scaffold assembly comprising:

a stackable scaffolding module having four elongated vertical support members which are generally parallel and co-extensive;

at least two work platforms to bear the weight of building materials and workmen, which platforms are supported by the support members at vertically spaced locations, said platforms having a parallelogram-like configuration;

pivot means to attach each platform to the support members so that each support member is located adjacent a respective one of the corners of each platform and permitting relative pivoting movement between each platform and the support members about two parallel axes extending generally parallel to the side of each platform;

releasable securing means for preventing pivoting of the platforms relative to the support members so that the module is foldable between an erect configuration with the platforms normal to the support members when a securing means is engaged and a folded configuration with the support members pivoted relative to the platform so that support members are located adjacent each other when the securing means is released thereby reducing the overall space occupied by the module to facilitate storage and transportation of the module; and a base assembly to support the module, including a plurality of vertical columns, and at least one adaptor means to be supported on one of the columns and having a pair of module engaging members to engage the adjacent lower end of a pair of support members of a pair of adjacent modules, so that the adjacent modules are at least partly supported on the adaptor.

2. The scaffold assembly according to claim 1, further comprising a pair of step up brackets attached to and supported by a pair of the support members, a platform member extending between the step up bracket so as to provide a further platform spaced from the platforms of the modules and extending outwardly from the module.

3. The scaffold assembly according to claim 1, wherein each module engaging member is a spigot to be telescopically received within an associated support member, and wherein the support members and spigots are each provided with apertures which are aligned when the support members are located on the spigots, and said combination further includes a pin to pass through the aligned passages of each pair of spigots and the associated support members.

4. A clamp to be attached to a building to secure a scaffold assembly to the building by a brace to extend between the scaffold assembly and the clamp, said clamp comprising:

a pair of co-operating clamp members defining a pair of clamp appertures to receive braces to secure the braces to the building;

a tension member is to extend between the clamp members to bring them into clamping engagement with the braces;

a replacement brace portion attached to one of the clamp members and moveable into one of the appertures to simulate one of the braces, when only one brace is engaged by the clamp.

5. The clamp of claim 4, wherein said tension member is located between the pair of appertures.

6. The clamp according to claim 4, wherein said replacement brace portion is pivotally attached to said one clamp member so as to be pivotable between a position located between the clamp members, and a position exposing one of the apertures for use.

* * * * *